US008864341B2

(12) United States Patent
Davis et al.

(10) Patent No.: US 8,864,341 B2
(45) Date of Patent: Oct. 21, 2014

(54) REFLECTIVE NANOFIBER LIGHTING DEVICES

(71) Applicant: Research Triangle Institute, Research Triangle Park, NC (US)

(72) Inventors: James Lynn Davis, Holly Springs, NC (US); Larry Charles Michael, Chapel Hill, NC (US); Karmann C. Mills, Apex, NC (US)

(73) Assignee: Research Triangle Institute, Research Triangle Park, NC (US)

( * ) Notice: Subject to any disclaimer, the term of this patent is extended or adjusted under 35 U.S.C. 154(b) by 0 days.

(21) Appl. No.: 14/103,110

(22) Filed: Dec. 11, 2013

(65) Prior Publication Data

US 2014/0160723 A1 Jun. 12, 2014

Related U.S. Application Data

(63) Continuation of application No. PCT/US2013/044933, filed on Jun. 10, 2013.

(60) Provisional application No. 61/674,714, filed on Jul. 23, 2012.

(51) Int. Cl.

| | |
|---|---|
| ***F21V 7/10*** | (2006.01) |
| ***F21V 13/08*** | (2006.01) |
| ***F21V 9/00*** | (2006.01) |
| ***F21V 5/00*** | (2006.01) |
| ***F21V 7/22*** | (2006.01) |

(52) U.S. Cl.

CPC ... *F21V 7/10* (2013.01); *F21V 9/00* (2013.01); *F21V 13/08* (2013.01); *F21V 5/00* (2013.01); *F21V 7/22* (2013.01)

USPC ..... 362/296.02; 362/296.01; 362/341

(58) Field of Classification Search

USPC ..... 362/296.01, 296.02, 341

See application file for complete search history.

(56) References Cited

U.S. PATENT DOCUMENTS

| | | | | |
|---|---|---|---|---|
| 2005/0095695 | A1 | 5/2005 | Shindler et al. | |
| 2008/0113214 | A1* | 5/2008 | Davis et al. | 428/690 |
| 2009/0303411 | A1* | 12/2009 | Kawato et al. | 349/61 |
| 2010/0177518 | A1 | 7/2010 | Walls et al. | |

(Continued)

FOREIGN PATENT DOCUMENTS

| | | | |
|---|---|---|---|
| WO | WO2012/024598 | A2 | 2/2012 |
| WO | WO2012/024598 | A3 | 2/2012 |

OTHER PUBLICATIONS

U.S. Appl. No. 14/123,248, filed Dec. 2, 2013, Davis, et al.

(Continued)

*Primary Examiner* — Anh Mai
*Assistant Examiner* — Zachary J Snyder
(74) *Attorney, Agent, or Firm* — Oblon, Spivak, McClelland, Maier & Neustadt, L.L.P.

(57) ABSTRACT

A fiber-based reflective lighting device. The lighting device includes a source configured to generate a primary light, a substrate including a mat of reflective nanofibers, and a light exit configured to emanate the reflected light. The fibers have an average fiber diameter AFD less than 500 nm which diffusively reflects visible light upon illumination with at least the primary light. The mat has a basis weight less than 40 gram per square meter (gsm) and a reflectance greater than 80%.

31 Claims, 16 Drawing Sheets

(56) References Cited

U.S. PATENT DOCUMENTS

| | | | |
|---|---|---|---|
| 2011/0194304 | A1 | 8/2011 | Han et al. |
| 2012/0033403 | A1 | 2/2012 | Lamvik et al. |
| 2012/0281428 | A1 | 11/2012 | Davis et al. |
| 2013/0308334 | A1 | 11/2013 | Davis et al. |

OTHER PUBLICATIONS

International Search Report and the Written Opinion of the International Searching Authority issued in International Application No. PCT/US2013/044933 mailed Sep. 24, 2013.

* cited by examiner

REFLECTIVE NANOFIBER LIGHTING DEVICES

CROSS REFERENCE TO RELATED APPLICATIONS

This application is a continuation of International Application PCT/US2013/044933, with an international filing date of Jun. 10, 2013 and claims the benefit of U.S. provisional application No. 61/674,714, filed Jul. 23, 2012, the entire contents of each application are incorporated herein by reference. This application is related to U.S. Application Ser. No. 61/492,563 filed Jun. 2, 2011, the entire contents of which are incorporated herein by reference. This application is related to U.S. Application Ser. No. 61/266,323 filed Dec. 3, 2009, the entire contents of which are incorporated herein by reference. This application is related to U.S. application Ser. No. 10/819,916, filed on Apr. 8, 2004, entitled "Electrospinning of Polymer Nanofibers Using a Rotating Spray Head,", the entire contents of which are incorporated herein by reference. This application is also related to U.S. application Ser. No. 10/819,942, filed on Apr. 8, 2004, entitled "Electrospray/electrospinning Apparatus and Method,", the entire contents of which are incorporated herein by reference. This application is related to U.S. application Ser. No. 10/819,945, filed Apr. 8, 2004, entitled "Electrospinning in a Controlled Gaseous Environment,", the entire contents of which are incorporated herein by reference. This application is related to U.S. Ser. No. 11/130,269, filed May 17, 2005 entitled "Nanofiber Mats and Production Methods Thereof,", the entire contents of which are incorporated herein by reference. This application is related to U.S. application Ser. No. 11/559,260, filed on Nov. 13, 2006, entitled "LUMINESCENT DEVICE," the entire contents of which are incorporated herein by reference. This application is related to U.S. Ser. No. 60/929,077, filed Jun. 12, 2007 entitled "Long-Pass Optical Filter Made from Nanofibers,", the entire contents of which are incorporated herein by reference. This application is related to PCT/US2008/066620, filed Jun. 12, 2008 entitled "Long-Pass Optical Filter Made from Nanofibers,", the entire contents of which are incorporated herein by reference. This application is related to PCT/US2009/043784, filed May 13, 2008 entitled "POROUS AND NON-POROUS NANOSTRUCTURES AND APPLICATION THEREOF,". This application is related to U.S. Application Ser. No. 61/169,468, filed on Apr. 15, 2009, entitled "STIMULATED LIGHTING DEVICE,", the entire contents of which are incorporated herein by reference.

This application is related to International PCT Application No. PCT/US2010/057007, the entire contents of which are incorporated herein by reference. This application is related to U.S. application Ser. No. 12/992,112, the entire contents of which are incorporated herein by reference.

BACKGROUND OF THE INVENTION

1. Field of the Invention

This invention is related to device and apparatus and methods for producing white light from luminescent particle excitation and emission.

2. Description of the Related Art

The choice of general illumination sources for commercial and residential lighting is generally governed by a balance of energy efficiency and the ability to faithfully produce colors as measured by the color rendering index (CRI). Existing fluorescent lighting is known to be economical from an energy consumption point of view, and is a widely used form of lighting in office buildings and retail stores. Incandescent light is also widely used and is recognized as having excellent spectral quality and the ability to accurately render colors. This high spectral quality is derived from the hot filament, which serves as a blackbody radiator and emits light over many wavelengths, similar to the sun. However, incandescent lighting suffers from very low energy efficiency. Solid-state lighting (SSL) is an alternative general illumination and lighting technology that promises the energy efficiency of fluorescent lights and the excellent spectral qualities of incandescent lighting. Typically, commercially available SSL lamps consists of a light emitting diode (LED) surrounded by a phosphor composed of large particles usually larger than 2 μm. The light emitted from the LED is of sufficient energy to cause the phosphor to fluoresce and emit one or more colors of visible light. The most common example of commercial SSL products consists of a blue LED (typically 460 nm) surrounded by a yellow phosphor, such as cerium-doped yttrium aluminum garnet (YAG:Ce), that emits lights in a broad band centered at 550 nm. The combination of nominally yellow light emission from the phosphor and blue light from the LED produces a light source that has a generally white appearance. Alternatively, an LED that emits in the ultraviolet (<400 nm) can be used to excite a blend of red, green, and blue phosphors.

Although luminaires utilizing either fluorescent, SSL, or incandescent lamps are constantly being introduced to the market with efficiency improvements, they have a basic flaw: the materials typically used in their construction absorb a large fraction of the light produced by the lamps in the luminaire. Therefore, more luminaires and lamps, requiring more energy, are necessary to achieve the lighting levels specified by electrical codes and the Illuminating Engineering Society (IES) guidelines.

In addition, while the light intensity from lamps used in current solid-state lighting products is sufficient for applications such as flashlights, it is considered too low and the emission cone is considered too narrow for use in general illumination applications such as room lighting. Hence, there is a need for solid-state light sources that are capable of providing high intensity white light emissions over a large enough area for use in general illumination.

One approach to improve the performance of SSL devices has been to use nanoparticles such as quantum dots as secondary converters to produce white light. "Quantum Dots Lend New Approach to Solid-State Lighting," Sandia National Laboratory press release Jul. 24, 2003. This approach incorporates quantum dots into a polymer used to encapsulate the light emitting diode (LED) and essentially creates a three-dimensional dome of quantum dots around the LED die. While this method has been successful in producing white light, the three-dimensional dome structure places large quantities of quantum dots in non-optimal positions around the LED and creates potential quantum dot agglomeration issues.

Previously, polymer/quantum dot compound nanofibers have been obtained from electrospinning of the polymer/quantum dot composite solutions, as disclosed in Schlecht et al., Chem. Mater. 2005, 17, 809-814. However, the nanofibers produced by Schlecht et al. were on the order of 10-20 nm in diameter, in order to produce quantum confinement effects. The size range of the nanoparticles and nanofibers disclosed therein is not advantageous for conversion of a primary light into secondary light emission across the white light spectrum.

Lu. et. al., Nanotechnology, 2005, 16, 2233, also reported the making of $Ag_2S$ nanoparticles embedded in polymer fiber matrices by electrospinning. Once again, the size range of the nanoparticles and nanofibers shown therein is not advantageous for conversion of a primary light into secondary light emission across the white light spectrum.

As described in U.S. application Ser. No. 11/559,260, filed on Nov. 13, 2006, entitled "LUMINESCENT DEVICE," referenced above, highly-efficient, light-producing sheets have been developed based on a combination of photoluminescent particles and polymer nanofibers. These luminescent sheets can be used in a white-light solid-state lighting device in which the sheets are illuminated by a blue light-emitting diode (LED) light source and the sheets will transform the incident blue light into, for example, yellow light. An appropriate mixture of yellow and blue light will produce the appearance of white light.

One particular advantage of these light-producing sheets is that photoluminescent particles are suspended in air on the nanofibers instead of being contained in a bulk material with a relatively high index of refraction. This arrangement prevents light from being trapped by total internal reflection, as occurs when the particles are encapsulated within bulk materials.

Other work (listed below and incorporated herein in their entirety by reference) has studied fibrous or porous nanofibers in optical configurations where the nano-scale optical properties of the nanofibers were observed.

1. P. Vukusic, B. Hallam, and J. Noyes, Science 315, 348 (2007);
2. J. L. Davis, A. L. Andrady, D. S. Ensor, L. Han, H. J. Walls, U.S. Patent Application U.S. 20080113214 (submitted November 2006); H. J. Walls, J. L. Davis, and D. S. Ensor, PCT Patent Application WO2009/032378 (submitted June 2007); and J. L. Davis, H. J. Walls, L. Han, T. A. Walker, L A. Tufts, A. Andrady, D. S. Ensor, in *Seventh International Conference on Solid State Lighting*, edited by I. T. Ferguson, N. Narendan, T. Taguchi, and I. E. Ashdown, (SP1E Proceedings 6669) pp. 666916-1-666916-9;
3. J. Yip. S.-P. Ng, and K.-H. Wong, *Textile Research Journal* 79, 771 (2009);
4. U.S. Pat. No. 5,892,621 Light reflectant surface for luminaires;
5. U.S. Pat. No. 6,015,510 Very thin highly light reflectant surface and method for making and using same;
6. U.S. Pat. No. 7,660,040 Diffuse reflective article;
7. U.S. Patent Application Publ. No. 2009/0137043 Methods for modification of polymers, fibers, and textile medium;
8. U.S. Patent Application Publ. No. 2010/0014164 Diffuse reflector, diffuse reflective article, optical display, and method for producing a diffuse reflector;
9. U.S. Patent Application Publ. No. 20100238665 Diffusive light reflectors with polymer coatings;
10. U.S. Patent Application Publ. No. 20100239844 Diffusive light reflective paint composition, method for making paint composition, and diffusely light reflecting articles;
11. U.S. Pat. No. 5,672,409, Polyester thin film reflector for a surface light source;
12. U.S. Pat. No. 6,015,510, Very thin highly light reflectant surface and method for making and using same;
13. US Patent Application 2010/0014164, Diffuse reflector, diffuse reflective article, optical display, and method for producing a diffuse reflector;
14. U.S. Patent Application 20100238665, Diffusive light reflectors with polymer coatings; and
15. U.S. Patent Application 20100239844, Diffusive light reflective paint composition, method for making paint composition, and diffusely light reflecting articles.

SUMMARY OF THE INVENTION

In one embodiment of the invention, there is provided a fiber-based reflective lighting device. The lighting device includes a source configured to generate a primary light, a substrate including a mat of reflective nanofibers, and a light exit configured to emanate the reflected light. The fibers have an average fiber diameter AFD less than 500 nm which diffusively reflects visible light upon illumination with at least the primary light. The mat has a basis weight less than 40 gram per square meter (gsm) and a reflectance greater than 80%.

In another embodiment of the invention, there is provided a method for diffusively reflecting visible light. The method directs a primary light beam to a mat of reflective nanofibers, and diffusively reflects visible light from the mat of reflective fibers. The fibers have an average fiber diameter AFD less than 500 nm which diffusively reflects visible light upon illumination with at least the primary light. The mat has a basis weight less than 40 gram per square meter (gsm) and a reflectance greater than 80%.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 13A-1, 13A-2 and 13A-3 depict a series of SEM micrographs at progressively higher magnifications of a reflective finer of this invention having a basis weight of 28 grams per square meter (gsm);

FIGS. 14A-1, 14A-2 and 14A-3 depict a series of SEM micrographs at progressively higher magnifications of a reflective fiber mat of this invention having a basis weight of 14 grams per square meter (gsm);

DETAILED DESCRIPTION OF THE EMBODIMENTS

Figure 1:
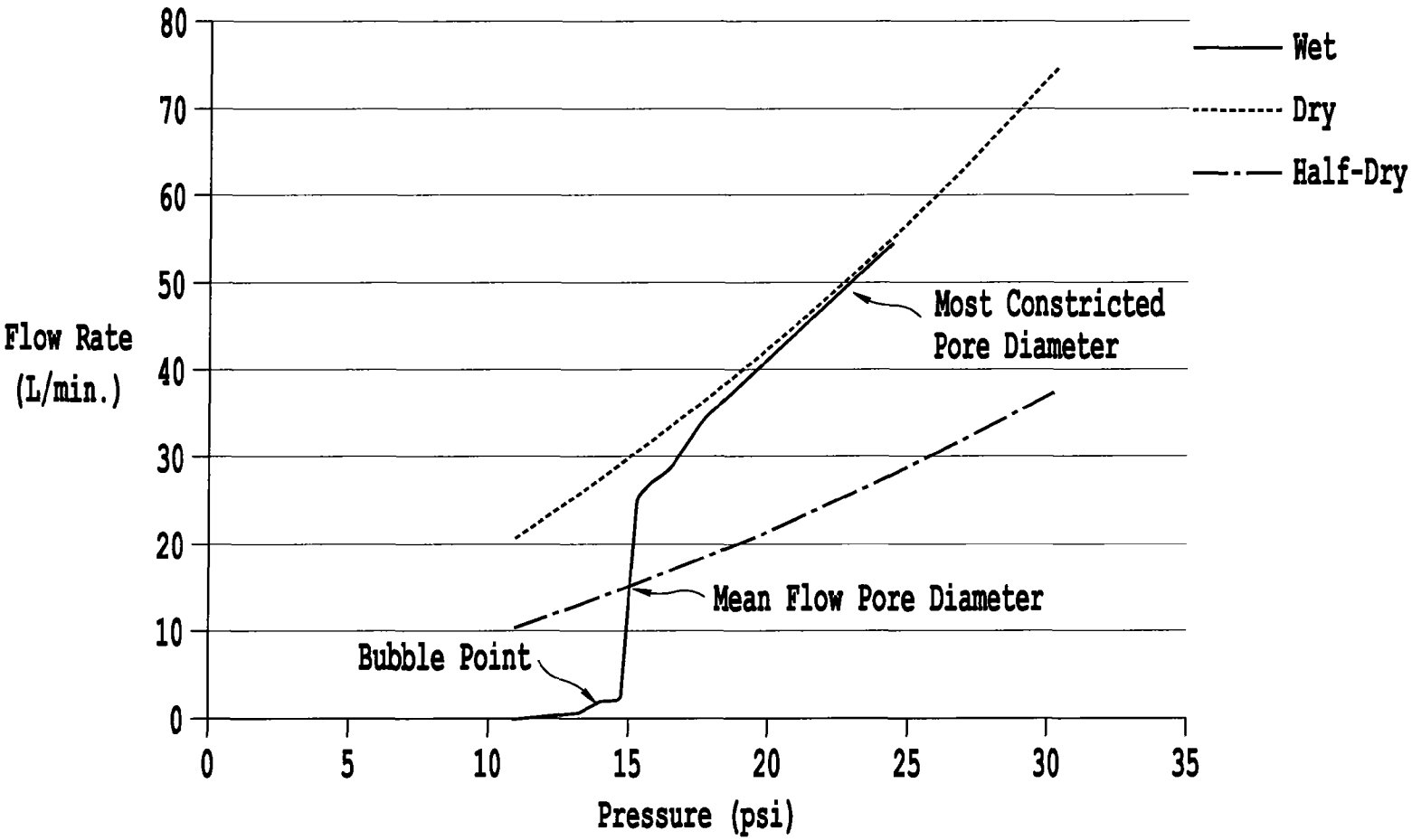
FIG. 1 is a schematic depicting data for extrapolation of mean flow pore diameter.

Lighting devices for general illumination generally produce multiple visible wavelengths either from a single source or lamp or from multiple sources. Common examples of lamps that can provide a broad range of visible wavelengths include incandescent lamps, fluorescent lamps, and phosphor converted light emitting diodes. A common example of lamps that provide a limited range of wavelengths is a light emitting diode, without a phosphor conversion layer. A lighting device can also contain a number of other components to mix and direct the light emerging therefrom. Examples of other components found in lighting devices include reflectors (both specular and diffuse), refractors, lenses, diffusers, and light mixing chambers. Additional information on lighting devices and their construction can be found in *The Lighting Handbook,* $10^{th}$ *Edition* (published by the Illuminating Engineering Society).

Light sources for general illumination can also be fabricated by combining a pump wavelength (e.g., blue emission in the 440-470 nm range; violet emission in the 380-440 nm range; or ultraviolet emission in the 330-380 nm range) with one or more photoluminescent materials that emit at wavelengths longer than the pump light. The photoluminescent material may be of multiple chemistries and particle sizes including phosphors, nanophosphors, and quantum dots. The luminescent material is often brittle and requires a binder or support matrix in order to be incorporated into practical devices.

In one embodiment of the invention, a fiber-based reflective lighting device includes a source configured to generate a primary light, a substrate including a mat formed from layers of reflective fibers, and a light exit configured to emanate the reflected light. The fibers in the fiber-based lighting device have an average fiber diameter AFD smaller than the wavelength of visible light being reflected and diffusively reflect visible light upon illumination with at least the primary light. Visible light is that portion of the electromagnetic spectrum that extends from about 380 nm to 770 nanometers.

More specifically, in one embodiment, a fiber-based reflective lighting device of this invention includes a source configured to generate a primary light, a substrate including a mat formed from layers of reflective nanofibers. The fibers have an average fiber diameter AFD less than 500 nm which diffusively reflects visible light upon illumination with at least the primary light. The mat has a basis weight less than 40 gram per square meter (gsm) and a reflectance greater than 80%. The nanofiber mat in one embodiment is characterized by interfiber spacings or pore diameters that can be measured using analytical techniques such as ASTM F316.

In one embodiment of the invention, the fiber mat has a maximum interfiber spacing, as measured by bubble point, an average interfiber spacing, as measured by mean flow pore diameter, and a smallest interfiber spacing, as measured by most constricted pore diameter. The nanofiber mat in this embodiment would have an average interfiber spacing less than 80% of the maximum interfiber spacing. The nanofiber mat in this embodiment would be configured to diffusively reflect at least 90% of incident light.

Accordingly, in one embodiment of the invention, there is provided a method for diffusively reflecting visible light. The method directs a primary light beam to a mat of reflective nanofibers, and diffusively reflects visible light from the mat of reflective fibers. The fibers have an average fiber diameter AFD less than 500 nm which diffusively reflects visible light upon illumination with at least the primary light. The mat has a basis weight less than 40 gram per square meter (gsm) and a reflectance greater than 80%. In one embodiment, as noted above, the mat has an average interfiber spacing less than 80% of the maximum interfiber spacing.

Nanofibers are a solid structure that has one dimension (diameter) in the 10-2000 nm range, and the other dimension (length) can be quite long in the meters range. During the fabrication process, a nanofiber mat can be formed from layers of nanofibers. Nanofibers suitable for the invention can be made from a variety of materials, including polymers, ceramics, and glasses, sol gels, and blends of materials can also be readily fabricated. One feature of nanofibers is their small diameter and consequently high surface area. Nanofiber diameters on the order of visible light (~500 nm) or even smaller can be readily produced creating very large surface areas. Another feature of nanofibers is that their random assembly into a mat creates variable spacing between the nanofibers. This spacing effectively creates pores through the layers of the mat that may allow air, solvents, or other fluids to travel through the nanocomposite mat. Typically, the diameters of these pores are variable, even within a given pore.

Measurements of the pore sizes of nanofiber mats are typically performed using liquid extrusion porometry. This method is described in detail in A. Jena and K. Gupta, "Advances in Pore Structure Evaluation by Porometry" and A. Jena and K. Gupta, "Characterization of Pore Structure of Filtration Media," the entire contents of which are incorporated by reference. In liquid extrusion porometry, a wetting liquid is applied to the nanofiber material and spontaneously fills all the pores of the nanofiber mat. The pressure across the nanofiber mat is steadily increased until gas flows occur through the mat. This pressure can be related to the pore diameter through the equation $$p=4\gamma \cos \theta/D \qquad \text{equation 1}$$

Where p is differential pressure, $\gamma$ is the surface tension of the liquid wetting the pores, $\theta$ is the contact angle of the liquid with the nanofiber, and d is the pore diameter. The inverse relationship between p and D indicates that the largest pores will be emptied at the lowest pressure and the smallest pores will be emptied only at the highest pressure. Since the pore diameter is likely to change along its length, the pore diameter measured in liquid extrusion porometry is actually the most constricted part of the part of through pores. Closed and blind pores are not measured in liquid extrusion porometry.

As the gas pressure across a liquid-filled nanofiber mat is steadily increased, a minimum pressure will be reached at which the gas flows through the mat, as shown in FIG. 1. This pressure occurs at the "bubble point" and is indicative of the largest pore diameter in the nanofiber mat, as shown in equation 1. The bubble point can be determined using the methods described in Jena and Gupta (noted above) or by using a standard test method such as ASTM F316 ("Standard test methods for pore size characteristics of membrane filters by bubble point and mean flow pore test), the entire contents of which are incorporated by reference. In liquid extrusion porometry, the pressure is continually increased until all of the liquid is removed from the pores of the nanofiber mat, and the gas flow characteristics of the nanofiber mat are identical to that of the dry state. This point is the most constricted through pore diameter, as given in equation 1. At a point between the Bubble point and the most constricted through pore diameter, is the mean flow pore diameter, which gives the value of an average pore in the mat. As shown in FIG. 1, the mean flow pore diameter is given by the intersection of the half-dry gas permeability curve of the nanofiber mat (calculated as one-half that of the dry gas permeability curve) with the wet permeability curve.

Other analytical methods, such as gas adsorption and mercury porosimetry, have sometimes been used to measure pore structures in fibrous media. While mercury porosimetry and gas adsorption can determine pore volume, they cannot measure bubble point or mean flow pore diameter. A comparison of the capabilities of porometry, porosimetry, and gas adsorption methods of pore characterization is given in Jena and Gupta. In the gas adsorption method, a gas is adsorbed on the nanofiber, usually at low temperatures. Pore volume is calculated using the Brunauer, Emmett, and Teller equation or similar adsorption isotherm. In mercury porosimetry, mercury, a non-wetting fluid, is forced into the pore volume under pressure. The high pressures required to force the non-wetting mercury liquid into the pore volume make this technique difficult to performance on nanofiber structures with small diameters. Hence, mercury porosimetry is typically performed on large fibers, such as melt-blown plexifilamentary fibers, as described in U.S. Pat. No. 7,660,040.

The lighting device in various embodiments described below can include luminescent particles combined with a polymeric material that provides mechanical strength and imparts desirable optical properties to the resulting photoluminescent layer. For example, it is desirable in some lighting applications to have a photoluminescent layer that includes a blend of light transmission and light reflection properties, which can be achieved through the judicious choice of materials for the composite. Alternatively, in some embodiments of the invention, it is desirable to have a photoluminescent layer that provides a high degree of light reflection. Alternatively, in some embodiments of the invention, it is desirable to have the reflective fiber mat layer of the present invention separate from the photoluminescent layer that provides a high degree of light reflection.

One way to control the transmission and reflection properties of either the photoluminescent layer or the reflective fiber mat layer is by controlling the index of refraction of the layer relative to the surrounding media. For example, a photoluminescent layer that is index matched with its surrounding medium will display a large light transmission, while a material that is not exactly index matching will display a mixture of light transmission and light reflection. The extent of light reflection in such a media is determined by the difference in the index of refraction of the photoluminescence layer to the surrounding media through the Fresnel equations.

In one embodiment of the invention, a reflectance-enhancing coating on either the photoluminescent layer or the reflective fiber mat layer can be an optically clear material which has a light transmission of at least 50% of light, and in other cases which has a light transmission of at least 70% of light, and in other cases which has a light transmission of at least 80% of light, and in other cases which has a light transmission of at least 90% of light, and in other cases which has a light transmission of at least 95% of light.

An alternative way to control the transmission and reflection properties of the fiber mat of either the photoluminescent layer or the reflective fiber mat layer is to introduce features with dimensions on the order of the wavelength of light. Such features, typically 100 nm to 800 nm in size, will promote scattering of the light beam, which increases the reflection coefficient. The features may be of a different refractive index than their surroundings which will impart transmission and reflection properties governed by the Fresnel equations. Examples of materials which can be incorporated into the fiber mat include such materials as polymeric nanofibers, natural and synthetic papers such as PolyArt®, and etched glasses and plastics.

Light scattering occurring in the reflective fiber mat or the photoluminescent layer may also be used to increase the ability of the material to diffuse light or spread its intensity over a larger area. In the extreme, light scattering can be used to produce a Lambertian scatterer in which the intensity of the object appears the same regardless of the viewing angle.

While described above as separate photoluminescent or reflective fiber mat layers, the present invention can incorporate into one mat structure these elements together to provide a mat with a high degree of diffuse reflectance and with the capability for color conversion.

The photoluminescent nanofibers of the invention can be created in one embodiment by adding a range of photoluminescent materials to a polymeric or ceramic material that imparts the ability to control the transmission and reflection of light. Such photoluminescent materials include phosphors, nanophosphors, and quantum dots.

Phosphors are a general class of materials that emit radiation when exposed to radiation of a different wavelength. In one embodiment of the invention, such phosphors are generally exposed to either a blue, violet, or ultraviolet light source (i.e., pump) and will absorb photons from the incident light source creating an excited electronic state. This excited state can emit a photon at a wavelength that is generally longer than the pump wavelength through the process of fluorescence or more specifically photoluminescence. Phosphors are generally made from a suitable host material (e.g., aluminum garnet, metal oxides, metal nitrides, and metal sulfides) to which an activator (e.g., copper, silver, europium, cerium and other rare earths) is added. Typically, the phosphor particle size is often 1 μm or larger. Recently, phosphors have been developed that are characterized by particles sizes below 100 nm. These nanophosphors often have similar chemistries as larger particle sizes but scatter light to a lesser degree due to their small size.

Particles having a size less than 50 nm often can be classified as quantum dots. Quantum dots are nanoparticles whose dimensions have an order of magnitude equivalent to or smaller than the size of an electron at room temperature (deBroglie wavelength). When the size of the quantum dot is roughly the same or smaller than the deBroglie wavelength of an electron, then a potential well is created that artificially confines the electron. The size of this potential well determines the quantized energy levels available to the electron, as described in the "particle-in-a-box" solution of basic quantum mechanics. Since the energy levels determine the fluorescent wavelengths of the quantum dot, merely changing the size of the quantum dot changes, to a first approximation, the color at which the quantum dot radiates visible light. Thus, the quantum confinement effects of the quantum dots directly influence the light emitted from the respective quantum dot, and a broad spectrum of colors may be achieved by assembling quantum dots of different sizes.

Representative quantum dots suitable for the invention include a cadmium selenide nanocrystalline core surrounded by a zinc sulfide shell and capped with organic ligands such as trioctylphosphine oxide or a long-chain amine such as hexadecylamine. Such core shell structures are sold by Evident Technologies of Troy, N.Y.

Other representative quantum dots may be fabricated from a variety of materials including but not limited to at least one of silicon, germanium, indium gallium phosphide, indium phosphide, cadmium sulfide, cadmium selenide, lead sulfide, copper oxide, copper selenide, gallium phosphide, mercury sulfide, mercury selenide, zirconium oxide, zinc oxide, zinc sulfide, zinc selenide, zinc silicate, titanium sulfide, titanium oxide, and tin oxide, etc. Of particular utility to the invention are quantum dots having a core of at least one of CdSe, InGaP, InP, GaP, and ZnSe. The optical properties of quantum dots are produced by this nanocrystalline core.

Figure 2:
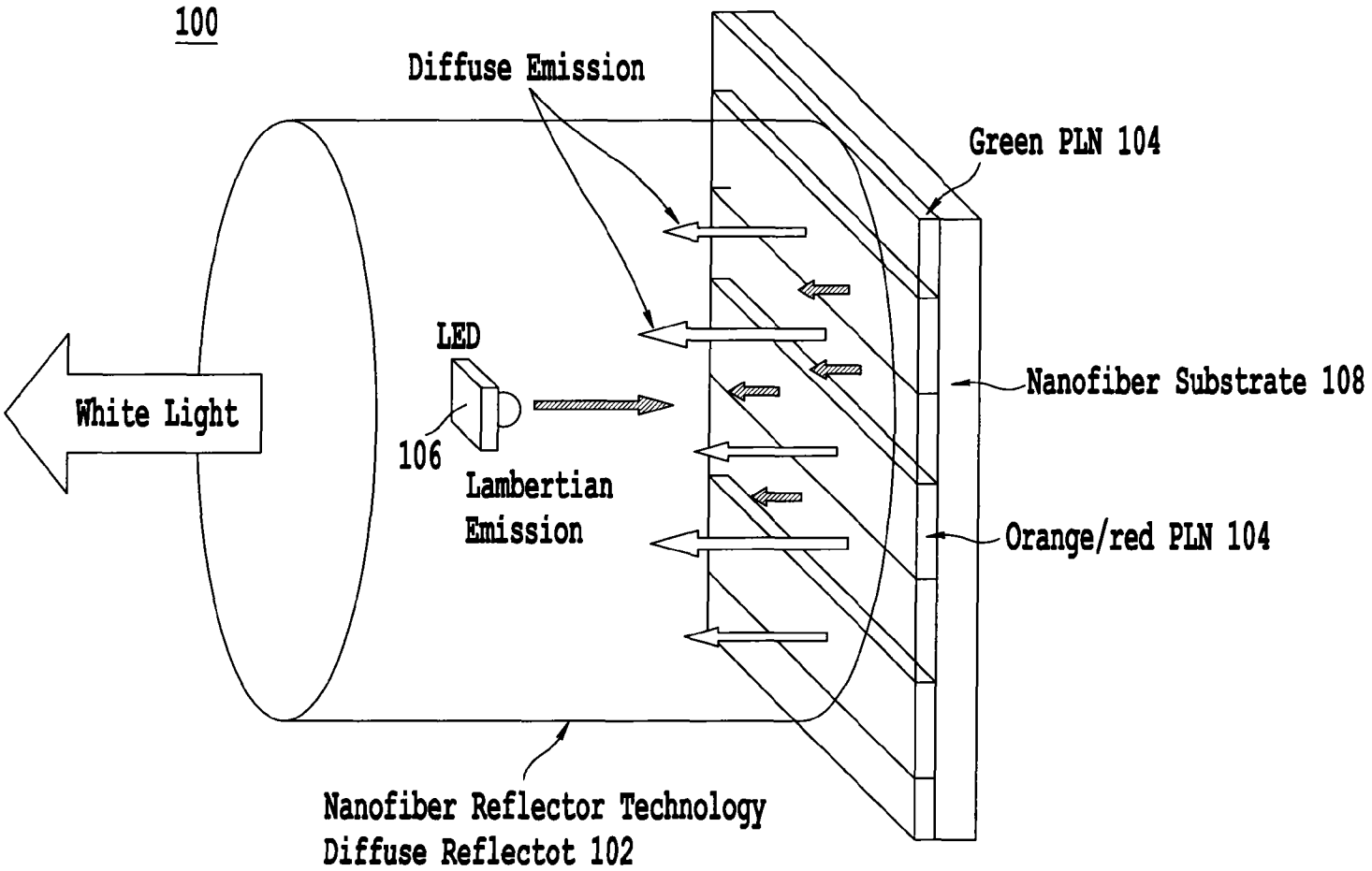
FIG. 2 is a schematic depicting a downlight device made using the reflective nanofiber and photoluminescent nanofibers.

Referring now to the drawings, wherein like reference numerals designate identical or corresponding parts throughout the several views, in various embodiments of the invention, FIG. 2 is a schematic depicting a downlight device 100 made using a reflective fiber mat (or diffuse reflector) 102 and photoluminescent fiber mat 104. Reflective fiber mat 102 includes nanofibers having an average fiber diameter AFD less than 500 nm which diffusively reflects visible light upon illumination with at least the primary light. The reflective nanofiber mat 102 in this embodiment surrounds the fiber mat 104 and serves to reflect light toward the exit depicted by the arrow in FIG. 2. The reflective nanofiber mat in this embodiment is characterized by layers of nanofibers that form interfiber spacings or pore diameters (measured using analytical techniques such as ASTM F316), as shown in FIG. 1. The fiber mat has a maximum interfiber spacing, as measured by bubble point, an average interfiber spacing, as measured by mean flow pore diameter, and a smallest interfiber spacing, as measured by most constricted pore diameter. The nanofiber mat in this embodiment would have an average interfiber spacing less than 80% of the maximum interfiber spacing.

One method to fabricate the nanofibers of this invention is through the process of electrospinning, as described in U.S. application Ser. No. 10/819,916, filed on Apr. 8, 2004, entitled "Electrospinning of Polymer Nanofibers Using a Rotating Spray Head,", the entire contents of which are incorporated herein by reference; U.S. application Ser. No. 10/819,942, filed on Apr. 8, 2004, entitled "Electrospray/electrospinning Apparatus and Method,", the entire contents of which are incorporated herein by reference; U.S. application Ser. No. 10/819,945, filed Apr. 8, 2004, entitled "Electrospinning in a Controlled Gaseous Environment,", the entire contents of which are incorporated herein by reference; U.S. Ser. No. 11/130,269, filed May 17, 2005 entitled "Nanofiber Mats and Production Methods Thereof,", the entire contents of which are incorporated herein by reference; U.S. application Ser. No. 11/559,260, filed on Nov. 13, 2006, entitled "LUMINESCENT DEVICE,", the entire contents of which are incorporated herein by reference. In electrospinning, a polymer solution is flowed to an electrode formed by a wire, needle, rotating drum or other conductive surface. A high voltage is placed between the electrode and a grounded collection plate. As the polymer solution is flowed past the electrode, the large (typically greater than 10 kilovolts) potential difference between the electrode and the grounded collection plate results in flash evaporation of the solvent to form a polymer fiber and electrostatic charging of the fiber. The electrostatic charge on the fiber during its transit from the electrode to the grounded collection plate results in instability and whipping within the fiber that results its diameter to the nanofiber scale. This process is further explained in "Science and Technology of Polymer Nanofibers" by A. L. Andrady (Wiley, 2008), the entire contents of which are incorporated by reference.

Figure 3:
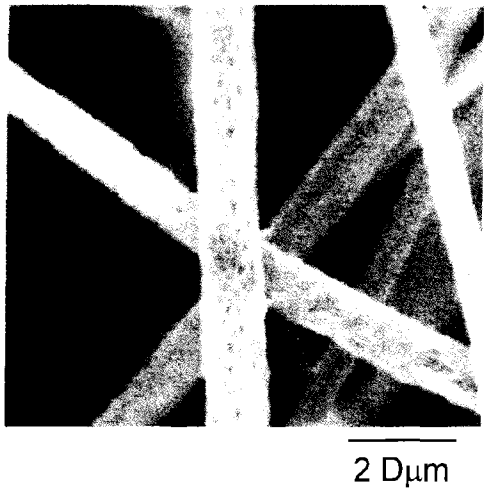
FIG. 3 is a micrograph of a mat of reflective fibers showing porous PMMA nanofibers.

Examples of polymer solutions used in this process include nylon dissolved in formic acid or acetic acid, polymethyl methacrylate dissolved in organic solvents such as toluene. Typically, the polymer concentrations in these solutions is in the 1% to 20% range. A mixture solvent system, such as toluene and N-methylformamide can also be used as described in WO 2009-140381 "POROUS AND NON-POROUS NANOSTRUCTURES AND APPLICATIONS THEREOF," the entire contents of which are incorporated by reference. The use of a mixed solvent system may result in intrinsically porous nanofiber morphologies as shown in FIG. 3.

In making a nanofiber reflector substrate using electrospinning as described in this embodiment, several critical system parameters need to be controlled. First, the electrospinning solution must be sufficiently dilute to achieve the intended average fiber diameter (<500 nm). This is typically achieved with a polymer solution in the 5% to 15% range. The chosen solvent is typically a chemical or chemical mixture that dissolves the polymer used to form the nanofiber substrate and evaporates quickly when the solution emerges from the spinerette. In the mixed solvent system used to produce porous fibers, a solvent and low vapor pressure, anti-solvent for the polymer are used to spin the fibers as described in WO 2009-140381 "POROUS AND NON-POROUS NANOSTRUCTURES AND APPLICATIONS THEREOF," the entire contents of which are incorporated by reference. If the spinning solution is too dilute, then the average fiber diameter is sub-optimal, and the reflectance profile suffers. A sub-optimal fiber diameter can be identified by a change in the reflectance value by more than 0.03 across the visible spectrum. If the spinning solution is too concentrated, the average fiber diameter is too large to produce efficient reflector materials and higher basis weights, resulting in higher costs, are necessary to compensate for this inefficiency and achieve reflectance values above 0.90.

Figure 4B:
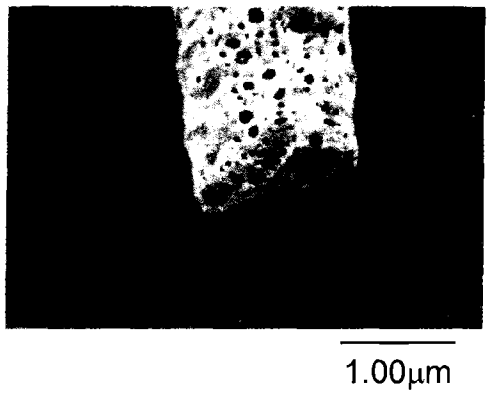
FIGS. 4A and 4B are micrographs of a mat of reflective fibers showing PMMA nanofibers that exhibit a porous morphology and a general ribbon-shaped appearance.
Figure 4A:
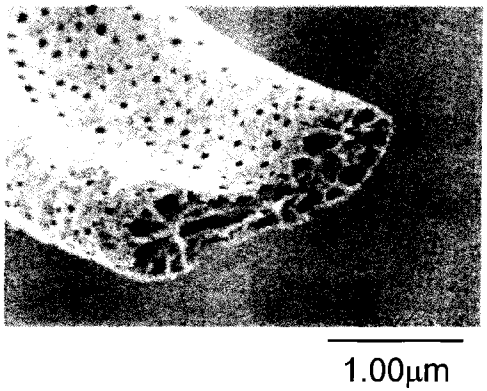

Second, the electrospinning system used with this embodiment is designed to produce sufficient fiber densities to achieve the bulk substrate properties as measured by mean flow pore diameter and bubble point that are described below. In a electrospinning system for producing the large amounts of material needed for lighting, this is typically achieved with a multiple spinerette architecture that can produce uniform fiber densities across the entire area covered by the nanofiber reflector substrate. If the fiber density is too low, the substrate exhibits higher transmittance than desired. Likewise if the fiber density is variable across its width or length, then the reflectance of the nanofiber reflector substrate will vary accordingly. Third, the collection belt for the nanofiber substrate is operated at a sufficient speed to ensure that the substrate basis weight remains below 40 gsm, more preferable below 30 gsm, and most preferably below 20 gsm. If the belt speed is operated at too high a rate, then sub-optimal basis weight, as evidenced by lower than desired reflectance at one or more wavelengths, is obtained. If the belt speed to too high, then excess material is incorporated into the substrate, increasing costs and decreasing flexibility of the material, without significantly improving reflectance. Common polymer nanofibers fabricated using electrospinning include nylon, polystyrene, polymethylmethacylate, silicone, polyimide, polyetherimide, polysulfone, and blends thereof. FIG. 4 is a micrograph of a mat of reflective fibers showing PMMA nanofibers that exhibit a porous morphology and a general ribbon-shaped appearance.

An alternative method to fabricate the nanofibers of the subject invention is through the process of centrifugal spinning or a closely related process called Force™ spinning. The details of centrifugal spinning are described in U.S. Pat. Appl. Publ. No. 2009/0160099 (the entire contents of which are incorporated by reference), the details of force spinning are described in U.S. Pat. Appl. Publ. No. 2009/02329020 (the entire contents of which are incorporated by reference), and the details of rotary spinning as described in U.S. Pat. Appl. Publ. No. 2010/0247908 (the entire contents of which are incorporated by reference). In these methods, shear forces arising from the high speed ejection of the polymer from a rotating spinnerette thin the film down to the nanofiber range. The nanofibers can be collected in layers either as they are ejected from the rotating spinnerette or formed into a mat using conventional means including air and electrostatic charging. Centrifugal spinning can be used on either polymer solutions (typical polymer concentration of 10% to 50%) or polymer melts. When polymer solutions are used in the nanofiber spinning process, common organic solvents including but not limited to formic acid, toluene, dimethyl formamide may be used. Common polymer nanofibers fabricated using centrifugal spinning include polyethylene, polypropylene, polyethylene terephthalate, polybutyleneterephthalate, nylon, polyimide, polyetherimide, polysulfone, polymethyl methacrylate, and blends thereof.

In making a nanofiber reflector substrate using centrifugal spinning or FORCE spinning as described in this embodiment, several critical system parameters need to be controlled. First, the spinning solution must be of the appropriate composition and viscosity to achieve the intended average fiber diameter (<500 nm). For centrifugal spinning, this can be achieved either through the use of a polymer solution (concentrations ranging from 10% to 50%) or a polymer melt heated to a sufficient temperature to reduce its viscosity. The solution composition in conjunction with the rotary rate of the centrifugal spinerette control the average fiber diameter of the end product. More viscous solutions require higher rotary spinning rates to achieve a fiber diameter <500 nm, compared to less viscous solutions. However, more viscous solutions will typically have a higher throughput and be able to produce more material in a given time frame. Second, the centrifugal spinning system is designed to produce sufficient fiber densities to achieve the bulk substrate properties as measured by mean flow pore diameter and bubble point required to achieve high reflectance across the entire nanofiber reflector substrate. In a centrifugal spinning system for producing the large amounts of material needed for lighting, this is typically achieved with a multiple spinerette architecture that can produce uniform fiber densities across a broad area. If the fiber density is too low, the substrate exhibits higher transmittance than desired. If the fiber density is too low, the reflectance of the material will decrease. Third, the collection belt for the nanofiber substrate is operated at a sufficient speed to ensure that the substrate basis weight remains below 40 gsm, more preferably below 30 gsm, and most preferably below 20 gsm. If the belt speed is operated at too high a rate, then sub-optimal basis weight is obtained. If the belt speed to too high, then excess material is incorporated into the substrate, increasing costs and decreasing flexibility, with significantly improving reflectance.

An alternative method to fabricate the nanofibers of the subject invention is through nanofiber meltblowing. In this process, polymer resin is heated above its melting point and then forced under high through a specially designed fiber extrusion head to produce fibers in the 300 nm to >1,000 nm range. The combination of fiber extrusion head and air velocity and direction are adjusted to achieve AFD values <500 nm, as required for high reflectance substrates. The fibers are typically collected on a belt using either air knives or electrostatic charge accumulation. Common polymer nanofibers fabricated using meltblowing include polyethylene, polypropylene, polyethylene terephthalate, polybutyleneterephthalate, and similar polyolefin and polyester materials.

In FIG. 2, light emerging from a light source 106 (e.g., a LED) is directed toward the photoluminescent fiber mat 104. In one embodiment, a photoluminescent material of the photoluminescent fiber mat 104 can be made by spray coating a layer of doped silicate phosphors onto a thick nanofiber surface. The photoluminescent material can be subsequently partially coated with a layer of red-orange emitting quantum dots (emission wavelength 600 to 620 nm). The light impinging upon the photoluminescent fiber is largely prevented from passing through the fiber base 108 by its reflective properties.

Instead, this light, both from the excitation source and that converted by the phosphor, is largely reflected away from the photoluminescent fiber mat 104 and the fiber base 108. This reflected light then encounters the reflective fiber mat 102, that line the walls of the lighting device 100. These reflective nanofibers in the reflective fiber mat 102 serve to mix the blue, green, and red light produced by this structure, so that only white light emanates from the exit of the lighting device. For simplicity, a nanofiber material exhibiting the ability to exhibit high diffuse reflectance across the visible spectrum is termed a nanofiber reflector (NFR). In FIG. 2, the NFR material is shown generically and may or may not include the enhanced reflectance coatings of the invention.

Accordingly, in one embodiment of the invention, the reflective nanofibers are diffuse reflectors. Diffuse reflectance is the process by which a light beam at a given incidence angle and luminous intensity is reflected from a material over a wide range of angles spreading the luminous intensity over these angles. In the ideal case, diffuse reflectance will produce a material that reflects light with equal luminance in all directions.

The polymer nanofiber reflective substrate base can be used in either an undoped form or doped with luminescent materials. The nanofiber reflective substrate base can display a variety of optical properties by varying the transmittance and reflectance of the material, which can be tailored and controlled during the fabrication process.

Doping of nanofibers to create photoluninescent nanofibers (PLNs) is typically performed using a coating process that concentrates the luminescent material at one surface of the substrate (as described in detail below). The phosphors or quantum dots (QD) can be loaded onto nanofibers with a sufficient loading to achieve virtually any desired lighting color. Phosphors are typically coated using either solvent—(e.g., spray coating) or aerosol-based (e.g., dry coating) methods, whereas QDs are typically applied using ink-jet printing methods.

While compatible with any phosphor chemistry, doped-silicate, garnet, and selenide phosphors have been demonstrated using for example cadmium selenide cores with zinc sulfide shells. The photostability of these quantum dots (QD) is size dependent, with the larger particles (i.e., orange/red) exhibiting the highest photostability. In one embodiment, a doped-silicate phosphor provides broad emissions centered in the green (~540 nm) and orange QDs are added to provide a narrow emission around 615 nm. The combination in one embodiment, when excited with a blue LED, produces white light (CCT: 2,700 to 5,000 K) with high color rendering indices.

In operation of a typical device, blue light emitted by a LED is directed at the PLN, and a portion of the blue light is converted into green and red emissions that are diffusely reflected away from the PLN. Unconverted portions of the incident blue radiation are also diffusely reflected by the nanofiber base of the PLN. The diffusely emitted light is confined and directed by a second nanofiber material that is designed to exhibit high diffuse reflectance (R 95%) (i.e., a nanofiber reflective NFR layer). In various embodiments of the invention, diffuse reflectance values range from 70% to 80%. In various embodiments of the invention, diffuse reflectance values range from 80% to 90%. In various embodiments of the invention, diffuse reflectance values range from 90% to 95%. In various embodiments of the invention, diffuse reflectance values are greater than 95%. The high reflectance of the NFR material minimizes light absorption and also serves to mix the red, green, and blue colors produced by the device. Light produced emerges from the device well mixed with good homogeneity.

In FIG. 2, the LED is in the light emission path and could absorb/block some of the emitted light. This disadvantage can be avoided with a downlight device made using the reflective nanofiber and photoluminescent nanofibers where the LED is moved to the exterior of the luminaire to remove the LED from the light beam and to provide for better heat sinking of the LED. Light from the LED enters the device through an aperture and is directed at the PLN. The NFR material lines the wall of this device as discussed above.

A typical spectrum obtained using a Cree XRE LED (Part No. CREROY-L1-00001-00801) operated at 200 mA to 800 mA. The measured properties of the device at an operational current of 200 mA were:

| | |
|---|---|
| CCT: 3852 K | Duv: 0.003 |
| CRI: 92 | Luminous Efficacy: 53 Lumens/Watt |
| NIST CQS: 91 | |

Duv is a measure of how far a given set of chromaticity coordinates lie from the Planckian locus (i.e., the blackbody radiator point for a give CCT). Low Duv values are preferred. CQS stands for color quality scale.

The introduction of the nanofiber liner in this example without the enhanced reflectance coatings of the invention increased the optical power output from this device by 49.8%. This increase is believed to be due to reduced absorption of the light in the down light configuration due to the presence of the reflective nanofiber material. Since the nanofibers exhibit high reflectance (typically greater than 90%), the use of the nanofiber material as a liner even without the enhanced reflectance coatings of the invention significantly reduces absorption by luminaire materials.

While not being limited to a particular phenomenological explanation, it is believed that the high reflectance of this material is due to Mie scattering arising from the nanoscale manipulation of the optical properties of the nanofiber and the spacing between them. The contrast in index of refraction between the nanofiber (n~1.5) and air creates sites for Mie scattering of light. The intensity of the reflected light (i.e., backscattering) will be proportional to the angular scattering distribution and the number of scattering sites. In smooth nanofibers, the scattering sites are provided by the nanofibers themselves and the areas between adjacent nanofibers. Since the probability for backscattering (i.e., reflection) is optimal for visible radiation when this spacing is on the order of the wavelength of light or slightly less, increasing substrate density (i.e., decreasing void volume) would improve reflection intensity to a point. On porous nanofibers, the introduction of surface pores increases the number of scattering sites and increases backscattering efficiency as a function of thickness. In addition, surface pores of diameter 100-250 nm can be shown to possess a high probability for backscattering of visible radiation. Hence, the properly designed porous nanofibers of the invention can also be shown to be efficient reflectors of visible radiation.

In one embodiment of the invention, an additional mechanism to impart a discontinuity in the index of refraction is provided by the introduction of nanomaterials into the nanofiber. Typically, these nanomaterials will have diameters between 50 nm and 400 nm, and be composed of materials that are known to exhibit low absorbance in the visible spectrum. Examples of such materials include $BaSO_4$, Teflon, $TiO_2$, and $Al_2O_3$. Such additives would be chosen to have an index of refraction different from that of the polymer used to make the nanofiber.

The making of flat, foamed, or ribbon fibers or otherwise non-cylindrical shaped fibers is described in earlier noted applications incorporated by reference, including PCT/US08/66620 "LONG PASS OPTICAL FILTER MADE FROM NANOFIBERS"; and WO 2009-140381 "POROUS AND NON-POROUS NANOSTRUCTURES AND APPLICATIONS THEREOF." In short, a polymer solution 2-10 percent (by weight) is mixed with an additive that is not volatile but that is of a high dielectric constant relative to the polymer to achieve the porosity, the dielectric constant of the additive compound in one embodiment is in the range of 50-189. In one embodiment, N-methylformamide is used as a liquid organic compound with a suitably high dielectric constant and is added to the solvent mixture with weight percentage of 1-20 wt %. Toluene is one solvent that can be used with the N-methylformamide. In one embodiment, toluene is used in the electrospinning mixture as a large weight percent of the mixture, for example in a range of the 80-99 wt %. Porous poly(methyl methacrylate) PMMA polymer nanofibers produced from these toluene/methyl formamide/PMMA are shown as an example in FIGS. 3 and 4. Conditions for the electrospinnning follow closely the illustrated example above except for the inclusion of the toluene, the substitution of the methyl formamide for the dimethylformamide, and the substitution of the PMMA for the polystyrene.

The average intrafiber pore size obtained using this approach was seen to depend on the weight fraction of the additive in the spinning solution. This effect was demonstrated for the range of 2% and 20% (by weight) of N-methylformamide. At levels exceeding 20%, the intrafiber pores were found to be too large to maintain the cylindrical shape of the nanofibers. Under these conditions, the porous fiber tended to collapse and fold into a ribbon. FIGS. 3 and 4 shows scanning electron microscopy (SEM) images of porous PMMA nanofibers made under electrospinning conditions +20 KV, 1.0 ml/Hr, collector grounded. Concentration of the organic compounds in the solvent mixture for the samples: (a) 98% toluene, 2% N-methylformamide; (b) 95% toluene, 5% N-methylformamide; (c) 90% toluene, 10% N-methylformamide; (d) 80% toluene, 20% N-methylformamide.

It is apparent that the addition of high dielectric constant compound, such as N-methylformamide, make the resultant nanofibers porous, and eventually into a ribbon shape, as compared with round, cylinder shape for smooth nanofiber prepared with a single solvent system. For nanofibers prepared with lower concentration of N-methylformamide, such as 2%-5%, instead of a perfect sphere or circular shape on the nanofiber surface, the intrafiber pore structures tends to become slightly more elongated, when viewed from outside the fiber with an SEM, especially along the longitudinal direction of the resultant nanofiber. When the concentration of the N-methylformamide increases 10%-20%, the round intrafiber pore opening tends to become even more elongated along the longitudinal direction of the resultant nanofiber, when viewed from outside the fiber with an SEM. When the N-methylformamide concentration reaches to 20%, the intrafiber pores started to merger into each other and form very rough surface features on nanofiber surface. These features can be characterized as round pores at certain experimental conditions and the existence of the threshold is clearly observed between 5% and 10% weight ratio N-methylformamide, where the pore size significantly increases and the shape becomes more elongated, when viewed from outside the fiber with an SEM.

In a similar fashion, porous nanofibers can be fabricated using either centrifugal spinning of nanofiber meltblown processes described above. Such fiber structures can be made using several different methods including thermally induced phase separation, fibrillation, island-in-the-sea, spinning of immiscible polymer blends followed by subsequent processing such as solvent processing or thermal annealing, and the addition of blowing agents such as carbon dioxide, pentanes, or chlorofluorcarbons to the polymer solution or melt.

It is observed that the intrafiber pore openings on the nanofibers range in shape from slightly elongated shapes to oval shapes and have an aspect ratio in the range of 1.1:1 to 10:1. The intrafiber pores are partially embedded into the surface of the nanofiber and in some instances have an estimated depth of 5-200 nm, although smaller pore depths may not be readily detectable. The intrafiber pores thus expose an interior surface of the nanofiber, providing for an increased surface area, as compared to a similar diameter nanofiber without intrafiber pores. Adjacent intrafiber pores can be totally separated from each other by a nanofiber wall material in between, or adjacent intrafiber pores can partially overlap forming larger cavities in the nanofibers.

Examples of other high dielectric constant compounds suitable for the invention include, but are not limited to: N-Methylformamide, N-Methylacetamide, N-Methylpropanamide, N-Ethylacetamide, N-Propylpropanamide, Formamide, N-Butylacetamide, N-Ethylformamide. Their compatible solvents include but not limited to toluene, dimethylformamide, chloroform, dichloromethane, dimethylacetamide, and acetone. The polymers include but not limited to are Poly(methyl methacrylate), Poly(butyl methacrylate), Poly(Benzyl methacrylate), Poly(caprolactone), Poly (vinyl alcohol), Poly(Acrylonitrile), Poly(carbonate), and blends thereof.

The following table provides a listing of the reflectance of common materials. In one embodiment of the invention, materials of this optical type are introduced for the specular reflective material. Such materials for example can include Al, Au, Ag, $TiO_2$, ZnO, $BaSO_4$, and Zn in particle or flake form.

Reflectance of Common Materials
Polished Al 0.60-0.70
Etched Al 0.70-0.85
White Plaster 0.90-0.92
White Paint 0.75-0.90
Porcelain Enamel 0.65-0.90
White Glass 0.75-0.80

In one embodiment of the invention, the addition of a nanofiber material designed to provide high reflectance can be used to increase the energy efficiency of lighting devices. The nanofiber can be used as a liner in downlights and for lighting troffers.

Thus, the reflective nanofiber mat or substrate of the invention in general provides for one or more of the following embodiments:

1. Nanofiber materials lining the walls of a luminaire such as a downlight, light troffer, or other lighting device.

2. A nanofiber fiber mat or substrate including smooth, randomly oriented nanofibers with average fiber diameters smaller than the wavelength of visible light or flat, ribbon-shaped fibers with intrafiber pores extending to the fiber surface with diameters smaller than the wavelength of light that impart of textured surface morphology.

3. A nanofiber material functioning as a diffuse (i.e., Lambertian) reflector or including features or additives that impart a gloss characteristic to the substrate. Such a substrate may exhibit both specular and diffuse reflection with the ratio of the two controlled by the relative composition of diffuse reflection sites and specular reflection sites.

This structure can be fabricated in an electrospinning chamber using for example needle spinning as described in the related applications. This structure can also be fabricated using a roll-to-roll spinning process as in an Elmarco Nanospider tool, as described in U.S. Pat. Appl. Publ. Nos, 2009/0148547 and 2010/0034914, the entire contents of these patent documents incorporated by reference herein. As described therein, production of nanofibers through electrostatic spinning of polymer solutions occurs by way of a spinning electrode which rotates around its longitudinal axis and having spinning elements positioned uniformly along the circumference of end faces which are subsequently plunged under the level of polymer solution in the reservoir of polymer solution. Due to the physical properties of the polymer solution and the spinning electrode, the spinning elements emerge from the reservoir covered by the polymer solution. Having emerged, the spinning elements with polymer solution subsequently approach to a collecting electrode, which is grounded or connected to an opposite voltage source other than that of the spinning elements of the spinning electrode. In the moment, when the spinning element approaches sufficiently to the collecting electrode, between it and the collecting electrode as a result of difference of their electric potentials, there is created a sufficiently strong electric field, which along the whole length of the spinning element initiates the spinning process. During the spinning process the polymer nanofibers are created from the polymer solution on surface of the spinning element, which through the action of force of electrostatic field move towards the collecting electrode.

In this roll-to-roll process, the spinning element remains in a position suitable for spinning of the polymer solution on its surface only for a certain time interval. After expiration of this time interval, the spinning element is moved away from vicinity of the collecting electrode and again plunged into the polymer solution in the reservoir of polymer solution. Meanwhile, other spinning elements containing the polymer solution for spinning on their surface are in position to electro spin, permitting a continuous production of nanofibers in this roll-to-roll process.

Other techniques can be used to fabricate the fibers of the reflective fiber mat of this invention. These techniques include electroblown spinning as described in U.S. Pat. No. 7,585,451 (the entire contents of which are incorporated by reference), centrifugal spinning as described in U.S. Pat. Appl. Publ. No. 2009/0160099 (the entire contents of which are incorporated by reference), force spinning as described in U.S. Pat. Appl. Publ. No. 2009/02329020 (the entire contents of which are incorporated by reference), and rotary spinning as described in U.S. Pat. Appl. Publ. No. 2010/0247908 (the entire contents of which are incorporated by reference).

In one embodiment of the invention, preference for a nanofiber structure that exhibits gloss or partial specular reflectance over traditional nanofiber structures (which exhibit diffuse reflectance) is provided by choice of the electrospinning parameters including, but not limited to:

1. Polymer solution concentration;
2. Polymer solution flow rate;
3. Electro spinning voltage gradient;
4. Spinneret to collector distance;
5. Spinneret size; and
6. Spinning chamber environment;

whose parameters determine the resultant relative composition of diffuse reflective sites to specular reflective sites.

4. A nanofiber fiber mat or substrate including additives such as high dielectric constant materials (e.g., ZnO, $BaSO_4$, $TiO_2$, $Al_2O_3$, etc.) which provide additional scattering sites and increase reflectance. These additives can be dispersed into the spinning solution and a composite of the nanofiber and high dielectric constant material is provided directly by spinning operation. In one embodiment of the invention, random, textured (i.e., porous) nanofibers are the most effective for use as optical filters and wavelength selective reflectors, as discussed above. In contrast, thin layers of smooth round nanofibers have been found to be poor scatterers of lights and are not as effective for either use.

More specifically, the nanofiber substrate can be coated with the high dielectric constant material using methods described in U.S. Patent Application 2008/0113214, herein incorporated by reference. In one embodiment of the invention, as discussed above, high dielectric constant materials such as for example ZnO, $BaSO_4$, $TiO_2$, $Al_2O_3$, etc can be applied to the fiber mats after electrospinning.

5. Photoactive fillers such as $TiO_2$ can be added to the nanofiber to provide continual cleaning of the nanofiber under the blue irradiation of the pump LED used in a solid-state lighting device. $TiO_2$ is a known photocatalyst and when excited by wavelengths of sufficient energy will oxidize organic compounds. The badgap of $TiO_2$ can be adjusted using known techniques such that the excitation wavelengths provided in solid-state lighting (i.e., 350 to 470 nm) are sufficient to initiate the photo-oxidation reaction. $TiO_2$ and similar photocatalytic additives can be dispersed into the electrospinning solution and a composite of the nanofiber and the photocatalytic material is provided directly by electrospinning operation. Alternatively, the nanofiber substrate can be coated with the photocatalytic material using methods described in U.S. Patent Application 2008/0113214, herein incorporated by reference.

6. The enhanced reflectance coatings can provide an improved diffuse reflector of light intended for use in a variety of optical applications including displays, solid-state lighting, high efficiency lighting, radiation detectors, and analytical instrumentation. The enhanced reflectance coatings can provide a mechanism for high-efficiency reflectance of visible light (e.g., reflectance values >0.95), environmental stability, and a thin profile (e.g., as thin as 200 microns).

While parylene-coatings have been applied on nylon nanofibers as the base substrate, other polymer nanofibers can be used as the base substrate including for example but not limited to polyethylene, polypropylene, polyethylene terephthalate, poly(methyl methacrylate), polysulfone, poly(vinyl alcohol), silicone, poly (vinylidene fluoride), poly(dimethyl siloxane) These nanofiber substrates can be fabricated using a variety of methods including, but not limited to, electrospinning, melt blowing, electroblowing, centrifugal spinning, force spinning, and rotary spinning, as described above.

A list of the index of refraction of various polymers (suitable for the invention but not limited to this list) is given below:

| | |
|---|---|
| Poly(dimethyl siloxane) | n = 1.40 |
| Poly(vinylidene fluoride) | n = 1.42 |
| Poly(ethylene oxide) | n = 1.454 |
| Poly(methyl methacrylate) | n = 1.49 |
| Poly(propylene) | n = 1.49 |
| Poly(vinyl alcohol) | n = 1.50 |
| Poly(ethylene) | n = 1.51 |
| Nylon 6 | n = 1.53 |
| Nylon 6, 10 | n = 1.57 |
| Nylon 6, 6 | n = 1.57 |
| Polycarbonate | n = 1.59 |
| DuPont Selar Polyamide | n = 1.59 |
| Polysulfone | n = 1.633 |
| Polyethylene Terephthlate | n = 1.64-1.67 |

In addition, a variety of coating methods may be used to create the enhanced reflectance coatings of the invention including, but not limited to 1. Vapor deposition of reactive monomers such as parylene,
2. Perfluorosilane based coatings available from Alexium Inc. (Greer, S.C.),
3. Vacuum plasma coatings, atomic layer deposition coatings from such as the Repellix coating from Integrated Surface Technologies (IST) (Menlo Park Calif.),
4. Perfluorinated coatings such as those available from P2i (Oxfordshire, UK),
5. Phosphonate dip coatings such as those from Aculon, Inc. (San Diego, Calif.),
6. Silicone coatings.

The refractive index of these coatings is likely to vary from roughly 1.35 (for some of the perfluorinated coatings) to >1.70 for ceramic nanocomposite coatings such as those from IST.

In addition, the enhanced reflectance coatings can be applied with a variety of coating methods including but no limited to spray coating, roller coating, extrusion coating, dip coating, inkjet printing, nanoimprint lithography, transfer coating, and dip-pen lithography.

Lighting Devices

A lighting device of the invention includes a reflector (e.g., a mat of reflective fibers as discussed above) and a source of primary radiation. This lighting device can be used by itself as a luminaire (i.e., lighting fixture) or in some cases can be used as a lamp that is contained in a luminaire. The reflector configuration including the mechanism for providing primary radiation and the mechanism for supporting reflective nanofiber sheets provides for efficiently directing the light emanating from the lighting device. The reflective nanofiber material used in this device is configured to provide a structure that takes advantage of the light scatter from the thick nanofiber substrate to provide a high (>0.80) reflectance.

The nanofiber substrate can be made from a variety of polymers including but not limited to polyamides, polyolefins, polyesters, polyacrylates, poly(methyl methacrylate), and poly(butyl methacrylate). The appropriate level of reflection is produced by providing a material containing discontinuities in the dielectric constant produced by either 1) a large macropore structure created by the void volume between adjacent fibers, 2) a macropore structure created by the introduction of pores onto the surface of the nanofiber, 3) the addition of high dielectric constant materials to the nanofiber, and/or the provision of the enhanced reflectance coatings of the invention.

In an additional embodiment, the source of primary radiation impinging upon a reflective nanofiber can be provided by a photoluminescent nanofiber made by combining luminescent particles and nanofibers, as described in U.S. application Ser. No. 11/559,260, which as noted above the entire contents of which are incorporated herein by reference. In this embodiment, there exists a mechanism for excitation illumination, and a mechanism for supporting luminescent sheets (formed from the luminescent particle/fiber composites described above). This lighting device can be used by itself as a luminaire (i.e., lighting fixture) or in some cases can be used as a lamp that is contained in a luminaire. The reflector configuration including the mechanism for exciting illumination and the mechanism for supporting luminescent sheets provides for efficient light conversion and emission from the luminescent particle/polymer composites described above. The reflector configuration of the invention is configured to accommodate the light-conversion material in a structure taking advantage of the light scatter from the nanoparticle/nanofiber composites described above. Light produced by the luminescent sheets strikes the reflective nanofibers and is directed toward the output of the lighting device. The high reflectance of the reflective nanofibers results in a high optical power emanating from the device than would occur in the absence of the reflective nanofiber.

The luminescent particle/polymer fiber composites can include luminescent nanoparticles supported by organic nanofibers. Most light-conversion phosphors in conventional white-light LEDs (light emitting diodes) are held within a solid material having a significant index of refraction, and various strategies are used with these materials to overcome total internal reflection and to extract the light efficiently from the solid material. The luminescent particle/polymer composites, including nanoparticle/nanofiber composites, (hereinafter referred to as "the luminescent sheet") described above do not suffer from total internal reflection.

In one embodiment of the invention, light conversion accepts short-wavelength light and converts the short-wavelength light to longer wavelengths. The combination of an LED producing short-wavelength light (for example, blue light) and an appropriate light-conversion mechanism (for example, one producing yellow light) provides an efficient way of producing white light for general illumination. In one embodiment of the invention, a range of incident (excitation) wavelengths are used which provide excitation (for example, light ranging from blue to ultraviolet). In one embodiment of the invention, the light-conversion mechanism of the particles emits a single color in response to the excitation light. In one embodiment of the invention, the light-conversion mechanism of the particles emits a broad band of wavelengths representing a wide range of colors (for example, from blue to red).

In one embodiment of the invention, the light-conversion material is relatively thick or reflective, so that the excitation light will not pass through the luminescent sheet in a significant amount, but is instead reflected to a high degree. A value of less than 70% transmittance in general would make the light-conversion material an optically thick material. Such an optically thick material is provided by a nanofiber substrate with a thickness in excess of 50 μm. Under this condition, the luminaire in this embodiment of the invention is arranged so that both sides of the luminescent sheet are illuminated by the excitation light, and emitted light is collected from both sides of the luminescent sheet for emanating from the luminaire.

In one embodiment of the invention, illumination from the excitation light source does not directly escape the luminaire. Accordingly, any light escaping the luminaire in this embodiment includes both 1) a component of the excitation light has been scattered from a matrix of the luminescent sheets without a change in wavelength (for example, blue light) and 2) emitted light produced by active luminescent particles (for example light having a longer wavelength than the excitation light such as yellow light).

Figure 5:
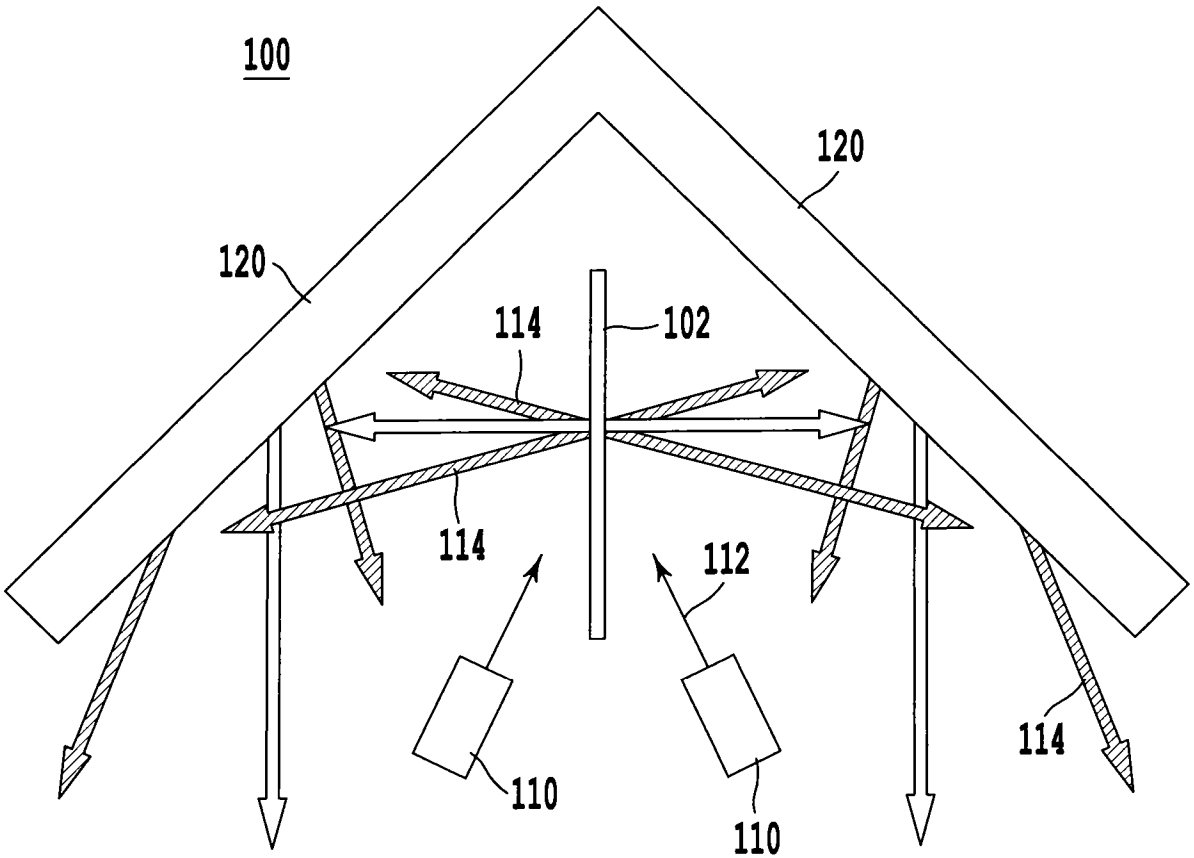
FIG. 5 is a cross-sectional depiction of a luminaire structure according to one embodiment of the invention.

As shown in FIG. 5, light sources 110 (producing the excitation light) produce light that is directed away from the exit of the luminaire shown at the bottom of the luminaire. More specifically, FIG. 5 is a cross-sectional depiction of a luminaire structure 100 according to one embodiment of the invention. The vertical center line depicts a luminescent sheet 102. Light sources 110 (e.g., light emitting diodes LEDs or other light sources) produce excitation light 112 which is directed to the luminescent sheets 102. In other embodiments, one or more separate (or integrated) excitation light sources 110 can be provided for each side of the luminescent sheet 102. Luminescent particles in the luminescent sheets 102 upon interaction with the primary light (i.e., excitation light 112) emit secondary light at a wide range of wavelengths. A reflector 120 containing reflective nanofibers with enhanced reflectance coatings made as described above reflects light back toward the luminescent sheet 102. Reflector 120 can include the enhanced reflectance coatings of the invention described above. The reflector 120 also reflects some light out of the luminaire 100. Excitation light 112 (for example, blue light) thus impinges on the luminescent sheet(s) 102 from multiple angles and impinges on the luminescent sheet(s) 102 on both sides. Some of the excitation light 112 scatters from the luminescent sheet 102 and exits the luminaire 100 at the bottom of the luminaire either directly or by reflection from the reflector 120. Emitted light 114 (for example, yellow light) created in the luminescent sheet can also exit the luminaire 100 at the bottom of the luminaire and can mix with the scattered excitation light 112.

FIG. 5 shows the excitation light 112 incident on the luminescent sheet 102 at a steep oblique angle, which in one embodiment maximizes the interaction of the excitation light with the luminescent sheet 102. The incident angle is a design variable which can be adjusted in the configuration of the luminaire 100 for maximum efficiency depending on the properties of the luminescent sheet 102. In general, the oblique angle varies from an angle of 15° to 85° to a normal to the luminescent sheet. In one embodiment of the invention, the luminescent sheet 102 is shown in a location separated from the reflector 120, allowing emitted light to reflect around the sheet. In general, the position of the luminescent sheet is set to a position for maximum efficiency. Efficiency in this context referring to the ratio of the amount of light produced by the luminaire (integrated over all directions, for example in an integrating sphere) to the power used to operate the luminaire.

Figure 11:
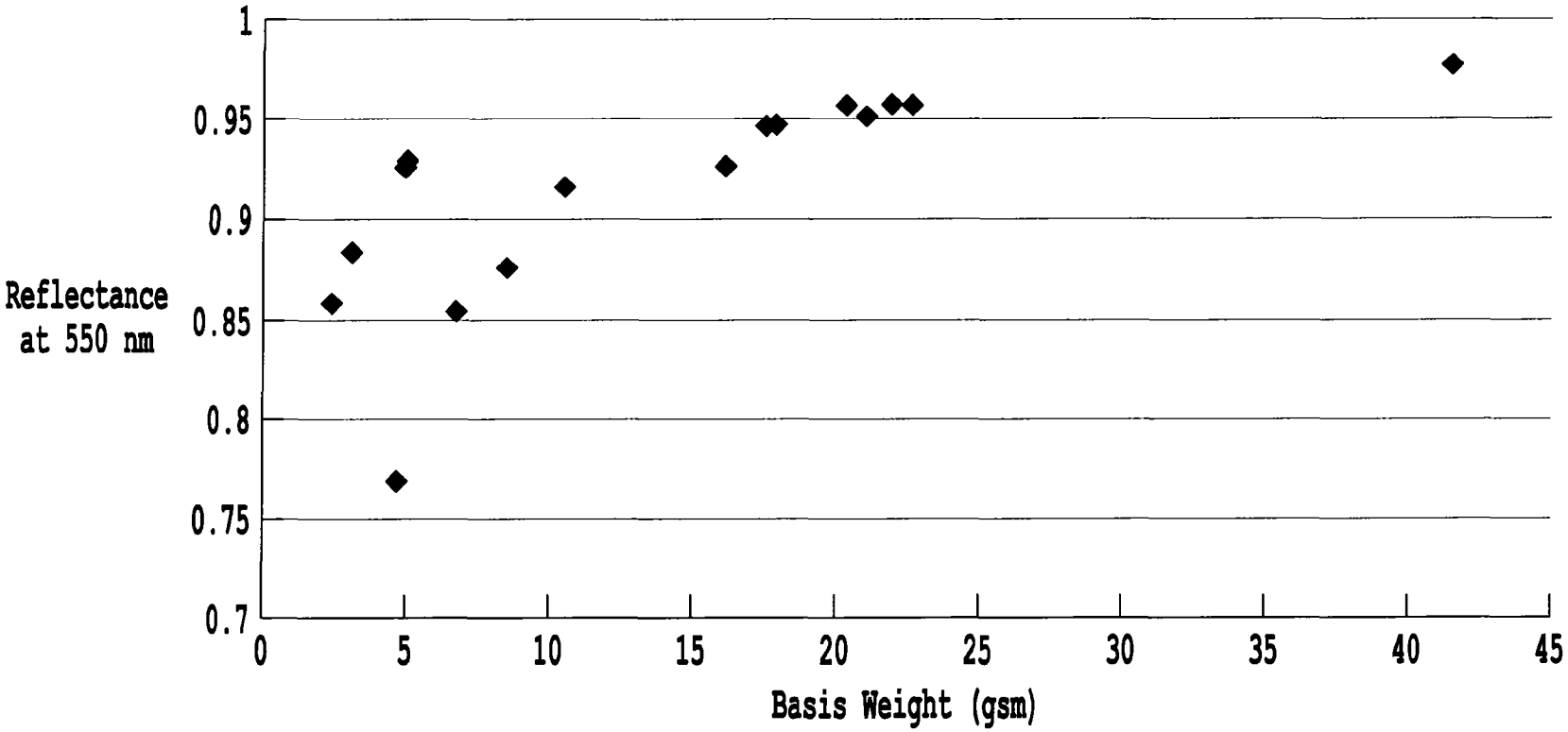
FIG. 11 is a depiction of a plot of nanofiber substrate reflectance at 550 nm as a function of basis weight.

Accordingly, in one or more embodiments of the invention, luminaire 100 includes a source of excitation light (for example, blue LEDs), a luminescent sheet (for example, one that converts blue light to yellow light), and a nanofiber reflector that directs the scattered light. Light can be directed from the excitation sources obliquely toward the luminescent sheet. The angle between the excitation source and the luminescent sheet is set to a value having the greatest efficiency. Efficiency in this context also referring to the ratio of the amount of light produced by the luminaire (integrated over all directions, for example in an integrating sphere) to the power used to operate the luminaire. The luminescent sheet 102 shown in FIG. 11 is located at a distance from the excitation source 110 and from the reflector 120. The reflector 120 is arranged to reflect light from the scattered and emitted light in a useful direction. While FIG. 5 shows a reflector 120 having two reflective nanofiber surfaces held at a right angle, in other embodiments, the reflector 120 can also be curved surface rather than planar surface, can include facets or surface features, and can be related by angles different from right angles.

In an alternative embodiment to that shown in FIG. 5, the excitation light source and luminescent sheets are replaced by a primary light source of desired spectral properties. Light emitted by the primary light source strikes the nanofiber reflector and is directed to the exist of the lighting device by the highly reflective nature of the nanofiber reflector.

In another luminaire 150 according to the invention, blue light (scattered from the luminescent sheet 102) and yellow light (emitted from another luminescent sheet) are mixed to form white-appearing light. For decorative purposes, the mix of luminescent particles can be altered to provide specific colors of illumination. The shape and size of the luminescent sheet 102 and the shapes and sizes of associated nanofiber reflectors can be altered to provide new design elements for decorative or architectural purposes. Luminescent sheets 102 of various kinds can be arranged to be easily substituted for each other, allowing color or shape to be changed conveniently and inexpensively by the user of the luminaire 100 or 150.

In an alternative embodiment to that shown in FIG. 5, the excitation light source and luminescent sheets are replaced by a primary light source of desired spectral properties. Light emitted by the primary light source strikes the nanofiber reflector and is directed to the exit of the lighting device by the highly reflective nature of the nanofiber reflector.

Figure 6:
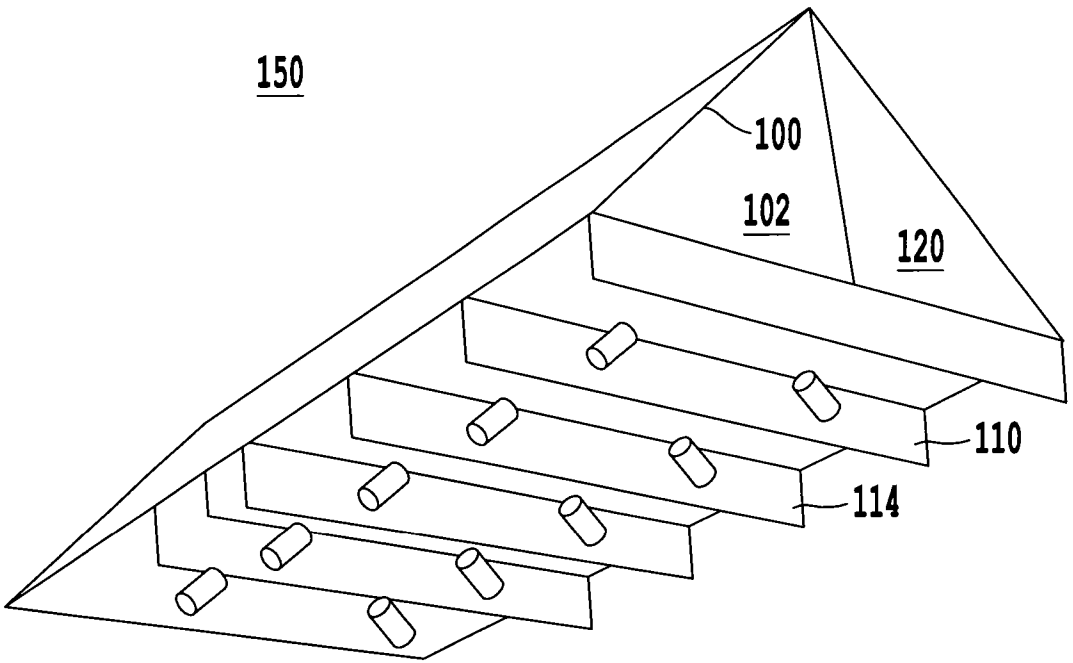
FIG. 6 is a perspective depiction of a similar luminaire structure according to one embodiment of the invention.

More specifically, FIG. 6 is a schematic depiction of luminaire 150 according to one embodiment of the invention. The view in FIG. 6 is from underneath the luminaire looking upward toward the planar nanofiber reflectors 120. Reflectors 120 can include the enhanced reflectance coatings of the invention described above. The vertical plane in the middle of luminaire 150 depicts luminescent sheet(s) 102 that converts a part of the excitation light from light sources 110 to secondary, emitted light. Cross-members 114 on the lower part of the luminaire 150 hold light sources 110 for producing the excitation light. The reflectors 120 (i.e., the nanofiber reflector substrates) direct light out the bottom of luminaire 150.

Figure 7A:
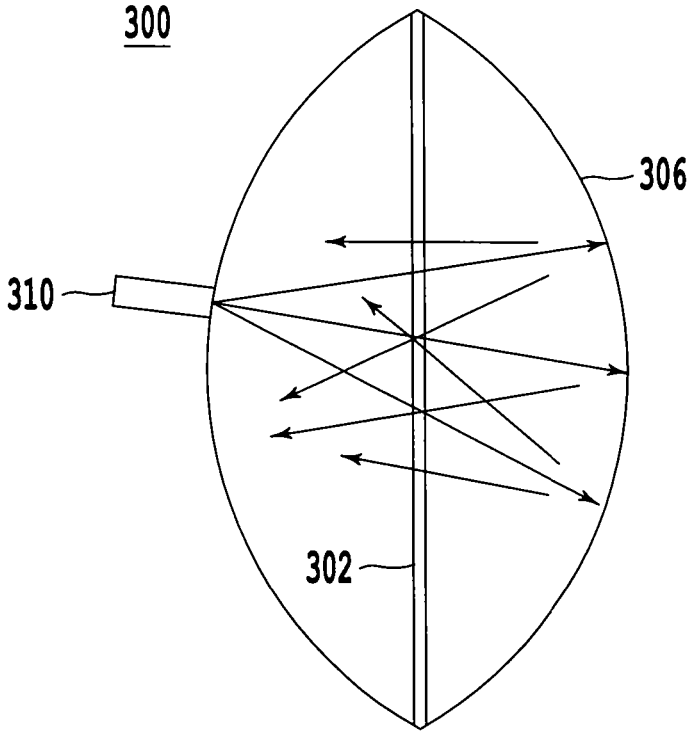
FIGS. 7A, 7B, 7C, and 7D are depictions of other light emitting structures according to one embodiment of the invention, from different perspective views.
Figure 7B:
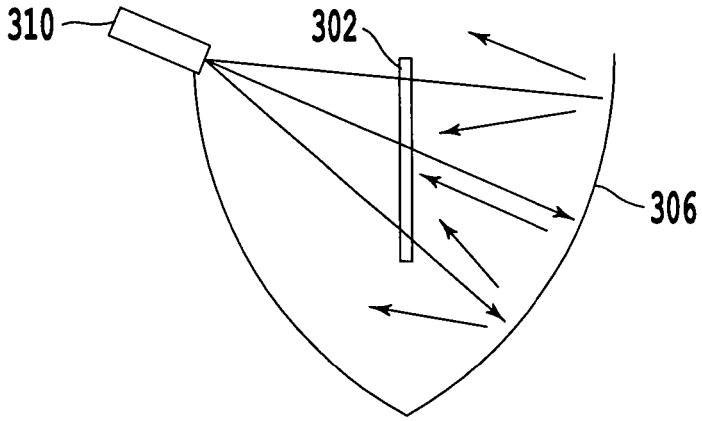
Figure 7C:
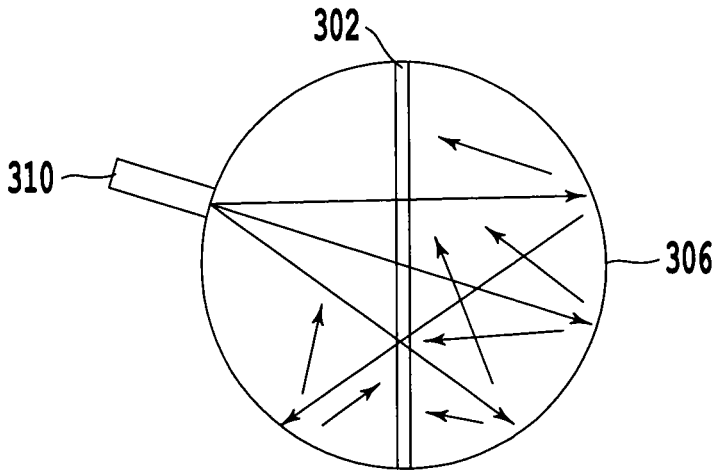
Figure 7D:
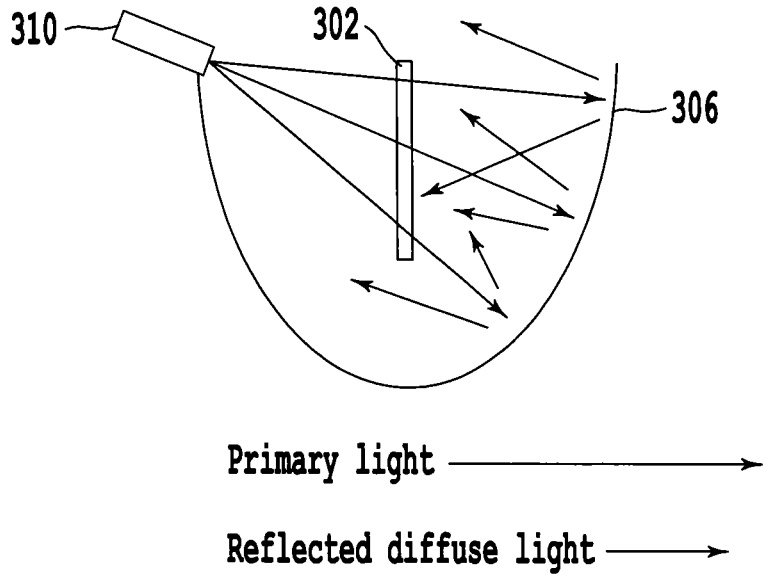

FIGS. 7A, 7B, 7C, and 7D are depictions of other light emitting structure 300 according to one embodiment of the invention, from different perspective views. FIG. 7A shows a top view of structure 300 whose outline includes segments of a full circle. A light source 310 such as for example an LED provides excitation illumination for the light-conversion material 302, located in this embodiment in the center of structure 300. Excitation light is transmitted through the light-conversion material 302 and reflected by the nanofiber reflector structure 306. Nanofiber reflector structure 306 can include the enhanced reflectance coatings of the invention described above. The nanofiber reflector could be used by itself (e.g., a formed sheet of nanofiber material) or laminated to a backing layer (e.g., metal, glass, paper such as PolyArt, etc.) to provide mechanical support. Unscattered excitation light is indicated by solid arrows. FIG. 7B is a side view of the structure 300, also showing an outline including segments of a circle. FIG. 7C is a top view of structure 300, showing the emission and scattering of light from the light-conversion material 302. Excitation light incident onto the luminescent sheet is not shown. Excitation light scattered from the matrix of the luminescent sheet without change of wavelength is indicated by solid arrows. Secondarily emitted light, having one or more wavelengths that are longer than that of the excitation light, is indicated by dashed arrows. While FIG. 7B illustrates unscattered excitation light, FIG. 7D illustrates scattered excitation light (indicated by solid arrows) and secondarily emitted light (dashed arrows). Depending on the composition of the luminescent material, the secondarily emitted light may have one wavelength or several wavelengths. In this part of structure 300, only light emitted from the right side of the light-conversion material 302 is shown, in order to illustrate more clearly the additional path for reflection of light underneath the light-conversion material 302.

In this embodiment, the outline of the top view of structure 300 is a full circle, and the light source 310 is not located at its center. In this configuration, some light is still scattered back toward the light-conversion material 302 and the opposite reflector surface 306. In the perpendicular plane (FIG. 7B), the light source 310 is in the center of the circle forming part of the side of structure 300, which is intended to optimize reflection back toward the light conversion material.

Figure 8:
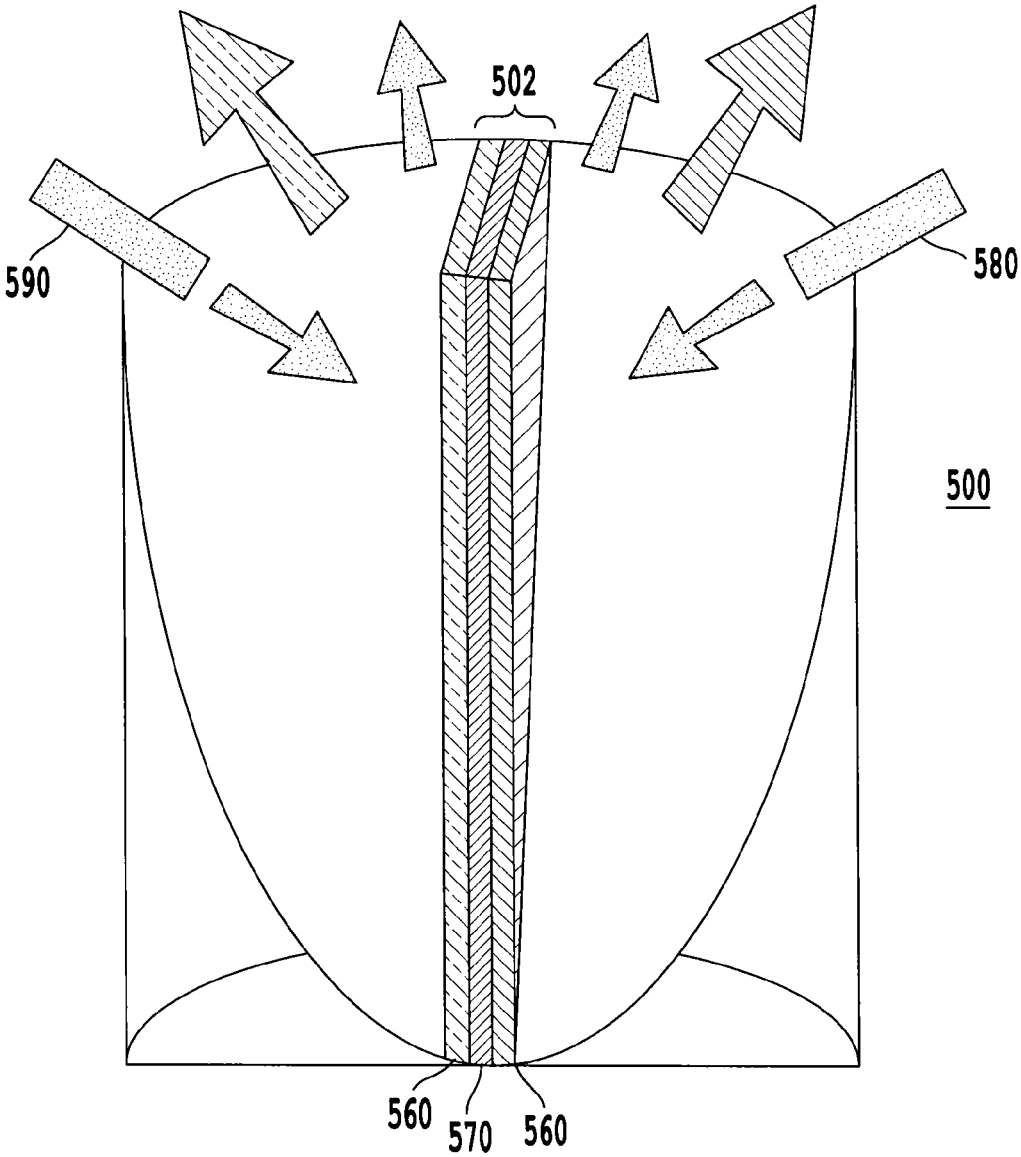
FIG. 8 is a depiction of another light emitting structure according to one embodiment of the invention.

Remote Phosphor Reflector Block:

A remote phosphor reflector block (RPRB) embodiment of the invention provides another mechanism for incorporating the light conversion materials discussed above. FIG. 8 is a depiction of a RPRB according to one embodiment of the invention.

In the RPRB embodiment, light-conversion material 502 is relatively thick or otherwise substantially diffusely reflective. Such a reflective conversion material does not permit substantial light to be transmitted through light-conversion material 502. Therefore, this material provides a mechanism to separate light of different colors in different compartments. Separation of colors of light is a benefit when mixed light converters are to be used. For example, light emitting structure 500 can include both a green converter layer 550 and a red converter layer 560 which both can interact with blue excitation light. Mixed converters 550, 560 (e.g., green and red) can be arranged to provide a wider color gamut or better color rendering quality than a single converter layer (such as for example a single yellow layer). In this regard, mixed converters can be advantageous. However, with mixed converters, it may happen that blue light is intercepted by a green converter, which emits green light, and the emitted green light can in turn be intercepted by a red converter which emits red light. Multiple conversions like this reduce the efficiency of light production. Efficiency in this context also referring to the ratio of the amount of light produced by the luminaire (integrated over all directions, for example in an integrating sphere) to the power used to operate the luminaire. It should be noted that, for the same power input to the structure 500, multiple conversions of light colors produce less total light than single conversions. To address this inefficiency, this embodiment of the invention segregates areas of different color conversion layers into different regions using reflective barriers 570. Reflective barriers 570 can include the enhanced reflectance coatings of the invention described above.

As before, for a balance of white light, illumination from the excitation light source should not directly escape the RPRB luminaire structure. Light escaping the luminaire structure should include excitation light scattered from the matrix of the light-conversion material without a change in wavelength (for example, blue light) combined with emitted light produced by the active luminescent particles that has a longer wavelength than the excitation light (for e.g., example, red and green light).

In the RPRB embodiment, a concave reflector made from reflective nanofibers holds an array of converting and reflective layers in a position parallel to the axis of the reflector. The converting layers (e.g., 550 and 560) are located in a position that divides the volume of the reflector into two volumes. The structure 500 includes two light sources (e.g., two LEDs or other light sources) to supply respectively excitation light (in this example, blue light) to the converting layers 550 and 560.

The central layer in FIG. 8 is a plane reflector for example made of reflective nanofibers (or other suitable reflector of light). The color converting layer 550 in FIG. 16 can be for example a layer of photoluminescent nanofibers that produces green light, while color converting layer 560 can be a layer of photoluminescent nanofibers that produces red light.

More specifically, in the configuration of FIG. 8, green and red photoluminescent nanofiber sheets (PLNs) 550 and 560 are placed back to back and separated by a reflecting layer 570 such as aluminum foil or an aluminum thin film. Each PLN is pumped by its own short wavelength LED 580, 590 such as those emitting wavelengths such as 410, 450, 460 or 470 nm. Light output from each LED can be adjusted by altering the LED driving voltage. The pump light and the red and green lights are not configured to mix until exiting the reflector 500.

By combining blue light from the emission source (i.e., the primary light) and emissions from red to green PLNs (i.e., the secondary light), white light is produced. Such white light can be used as is or optically mixed to eliminate any vestiges of the separate R, G, or B lights by using devices such as an integrating sphere or high transmittance diffuser polymeric film such as those available from Brightview Technologies. Alternatively, the diffuse reflection properties of the reflective nanofiber material serve to optically mix the separate R, G, B light. This is an important advantage of the nanofiber reflector material which optically mixes the separate R, G, B lights to produce white light emanating from the structure.

In the various embodiments described above, the light sources can be LEDs used to excite the PLNs (or color conversion layers) which may emit one primary wavelength or emit different primary wavelengths. For example, one LED could emit at 460 nm and the second could emit at 410 nm.

One advantage of the nanofiber base of the PLNs is that it represents a diffuse Lambertian reflector under certain circumstances. Thus, light incident on a diffuse reflecting nanofiber will not be specularly reflected but rather will be scattered at all angles with a cosine θ dependence with respect to the surface normal (i.e., following Lambert's emission law).

An alternative to having separate green and red PLNs, each pumped by a blue light, is to have a green PLN excited by a blue LED and in the second compartment have a red LED impinging on an undoped nanofiber substrate. This design could still be configured to emit blue, green and red light in the proper proportionality to generate white light, and the reflective layer may not be required. This approach represents a solution to the so-called "green gap" of low performing LEDs. Alternatively, green or red phosphors could be used in place of quantum dots. Alternatively, blue and red LEDs could be aimed at a green PLN to produce white light. Multiple blue or red LEDs can be added to the reflector block to impart greater control over the light produced.

In addition to the embodiments listed above, there are several additional embodiments of this invention. These embodiments include:

1) Incorporation of an optically clear encapsulant such as an epoxy or a silicone-based encapsulant available from suppliers such as General Electric or Dow Corning in at least a portion of the RPRB structure. Such encapsulants may or may not contain luminescent particles. With this embodiment, the index of refraction of these encapsulants is chosen to enhance the reflectance of the nanofiber reflector especially with regard to reflection at longer wavelengths by using the enhanced reflectance coatings of the invention.
2. In addition, the reflector block can be made out of reflective materials including but not limited to stamped metal, metallized plastics, and metallized glass. Reflective nanofiber substrates can be attached to these structures through adhesives to provide for high reflectance as described above.
3. The RPRB can be incorporated into a larger structure to create other lighting devices such as lamps or luminaires. For example, the RPRB could be formed in the base of a glass "Edison" bulb where a portion of the glass walls may be metallized to provide some of the functionality of the reflector block. In this embodiment, the frosted coating on the "Edison" bulb would be used as a means of mixing the red, green, and blue colors to produce white light. The electrical drivers for the RPRB "Edison" bulb could be contained in the Edisonian socket in much the same way that the ballast for compact fluorescent lights is contained at the base of the bulb.
4. In addition to incorporating luminescent nanoparticles into the PLNs as described above, other luminescent materials and phosphors can be incorporated into the PLNs. One example includes the incorporation of green phosphors such as the sulfoselenide compositions sold by PhosphorTech or doped silicates sold by Internatix, as discussed above.
5. Additional optical elements such as low-pass optical filters can be added at the input port of the light source to prevent loss of the secondary emission from the photoluminescent nanofiber.

Presently, the RPRB embodiment has yielded the following color rendering indexes (CRI) and correlated color temperatures (CCT). By comparison, measured values for commercial white LEDs have a range of CCT values depending upon the color of the lamp. "Cool white" lamps have CCTS between 5,000 K and 10,000 K, "neutral white" lamps have CCTs between 3,700 K and 5,000 K, and "warm white" lamps have CCTs between 2,600 K and 3,700 K. The typical CRI of these lamps is approximately 83. Higher CCTs correspond to a bluish appearance of the light source whereas lower CCTs correspond to a more reddish appearance. CRI refers to the ability to reproduce colors accurately and values above 80 are acceptable for general illumination.

In one embodiment of this invention, the fiber-based nanocomposite reflector can be used in conjunction with a liquid crystal display (LCD) or similar display device used in televisions, computers, cellular phones, or other mobile electronics. Often, LCDs will contain an optical cavity that provides lighting to aid in viewing the display, as described in U.S. Pat. No. 7,660,040. A lamp to improve the visual appearance of the display can be either located within the optical cavity and behind the LCD (i.e., backlight) or introduced from the side of the display (i.e., edge lit). The brightness of the display will depend on the fraction of the light emitted from this lamp that ultimately travels through the display and is seen by the user. Lining the display optical cavity with the reflective nanofiber composite of the current invention will increase the light output from the display due to its high reflectance.

Improved Nanofiber Reflectors

For improved reflectance performance, the inventors have discovered the synergistic interaction of various fiber properties which improve the overall reflectance. This invention therefore provides additional definition of the nanofiber structure configuration(s) permitting high reflectance nanofiber substrates to be obtained.

The properties of a non-woven substrate can be determined by optimizing several parameters including:

Basis weight—which is the weight of the polymer substrate per unit area and is typically given in units of grams per square meter or gsm;

Mean flow pore diameter—which is the average pore diameter (i.e., interfiber spacing) as measured using porometer instruments such as the CFP-1500A Automated Capillary Flow Porometer sold by PMI of Ithaca, N.Y.; (For thin substrates such as described herein, an lightweight organic liquid such as Galwick is often used in the porometer.)

Bubble point—which is the maximum pore diameter (i.e., interface spacing) as measured using a porometer.

Reflectance—the value of light reflected by the nanofiber substrate as measured with the aid of an integrating sphere.

Average fiber diameter (AFD)—which is the average of at least 100 different measurements of fiber diameter within a single substrate.

Figure 9:
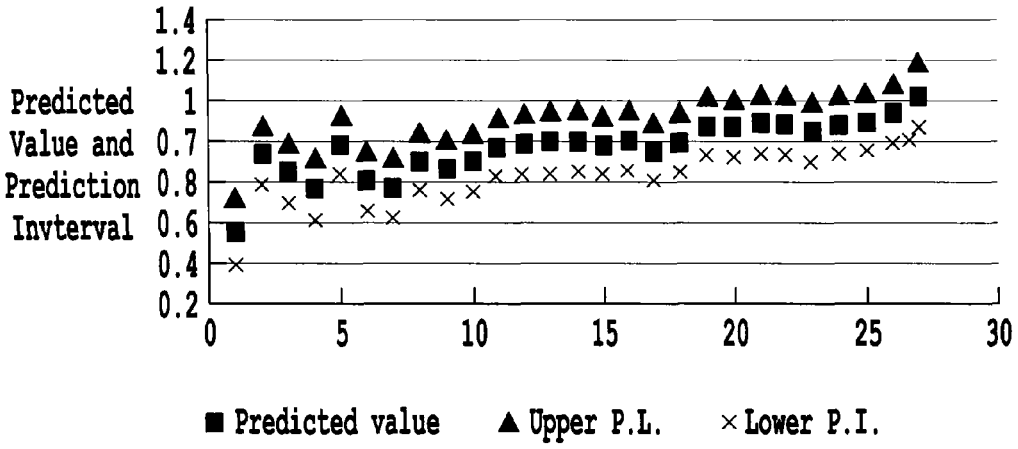
FIG. 9 is a graphical depiction of predicted values and intervals for modeled reflectance at 550 nm.

Reflectance can be measured at a number of wavelengths. However, for the purposes of this disclosure, only the reflectance of visible light is of interest. Common visible wavelengths of interest including 550 nm (green) and 750 nm (dark red). The reflectance of a series of nanofibers of varying physical properties was measured, and a model of the reflectance determined using statistical software to perform a statistical analysis of the data. FIG. 9 is a graphical depiction of predicted values and intervals for modeled reflectance at 550 nm.

In this example, reflectance at 550 nm was used as a surrogate for visible light reflectance. A number of predictor variables were included in the original model, but only two variables, basis weight and mean flow pore diameter were identified as being significant to the resultant reflectance value. In the model results shown below, reflectance at 550 nm is indicated by the variable REFLECT550, basis weight is indicated by the variable BASISWT, and mean flow pore diameter by the variable POREDIAM.

Based on this model, the reflectance of a nanofiber substrate can be estimated by:

REFLECT550=0.00596*BASISWT−0.03173*POREDIAM+0.7793

Prediction intervals for this model, using the mean values for each of the predictors are shown in Table 1, which shows a relationship between basis weight, mean flow pore diameter, and reflectance.

TABLE 1

| Variable | Parameter Estimate | Standard Error | F Statistic | Pr > F |
|---|---|---|---|---|
| Intercept | 0.77930 | 0.02955 | 695.35 | <.0001 |
| BASISWT | 0.00596 | 0.00139 | 18.38 | 0.0003 |
| POREDIAM | −0.03173 | 0.00348 | 83.00 | <.0001 |

Figure 10:
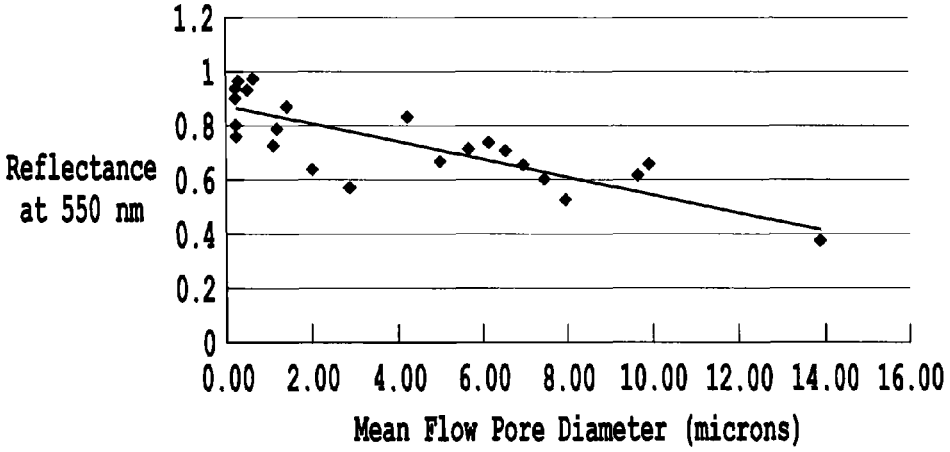
FIG. 10 is a graphical depiction of a negative correlation between mean flow pore diameter and reflectance for various nanofiber substrates.

Based on this analysis, it appears that POREDIAM has a statistically significant negative impact on reflectance in a nanofiber substrate. Specifically, FIG. 10 is a graph showing a negative correlation between mean flow pore diameter and reflectance for various nanofiber substrates. The negative correlation means that reflectance increases as mean flow pore diameter decreases. A least squares fit has been added to the graph as an aid to the eye.

BASISWT also has a significant impact on reflectance as shown in FIG. 11. Specifically, FIG. 11 is a plot of nanofiber substrate reflectance at 550 nm as a function of basis weight (in units of grams per $m^2$ or gsm). A positive correlation to an asymptomic value is readily apparent.

From the modeling results, it was found that some variables were highly correlated. In particular, POREDIAM and bubble point (denoted as BUBBLEPT) were found to be highly correlated. This suggests that POREDIAM and BUBBLEPT are interrelated. Table 2 shows a Pearson correlation chart showing a high degree of correlation between POREDIAM and BUBBLEPT.

TABLE 2

Pearson Correlation Coefficients
Prob > |r| under H0: Rho = 0
Number of Observations

| | REFLECT-550 | BASISWT | POREDIAM | BUBBLEPT |
|---|---|---|---|---|
| REFLECT550 | 1.00000 | 0.26916 | −0.78055 | −0.64879 |
| REFLECT550 | | 0.0615 | <.0001 | 0.0011 |
| | 49 | 49 | 22 | 22 |
| BASISWT | 0.26916 | 1.00000 | −0.02433 | −0.16407 |
| BASISWT | 0.0615 | | 0.9144 | 0.4656 |
| | 49 | 49 | 22 | 22 |
| POREDIAM | −0.78055 | −0.02433 | 1.00000 | 0.78239 |
| POREDIAM | <.0001 | 0.9144 | | <.0001 |
| | 22 | 22 | 22 | 22 |
| BUBBLEPT | −0.64879 | −0.16407 | 0.78239 | 1.00000 |
| BUBBLEPT | 0.0011 | 0.4656 | <.0001 | |
| | 22 | 22 | 22 | 22 |

Figure 12:
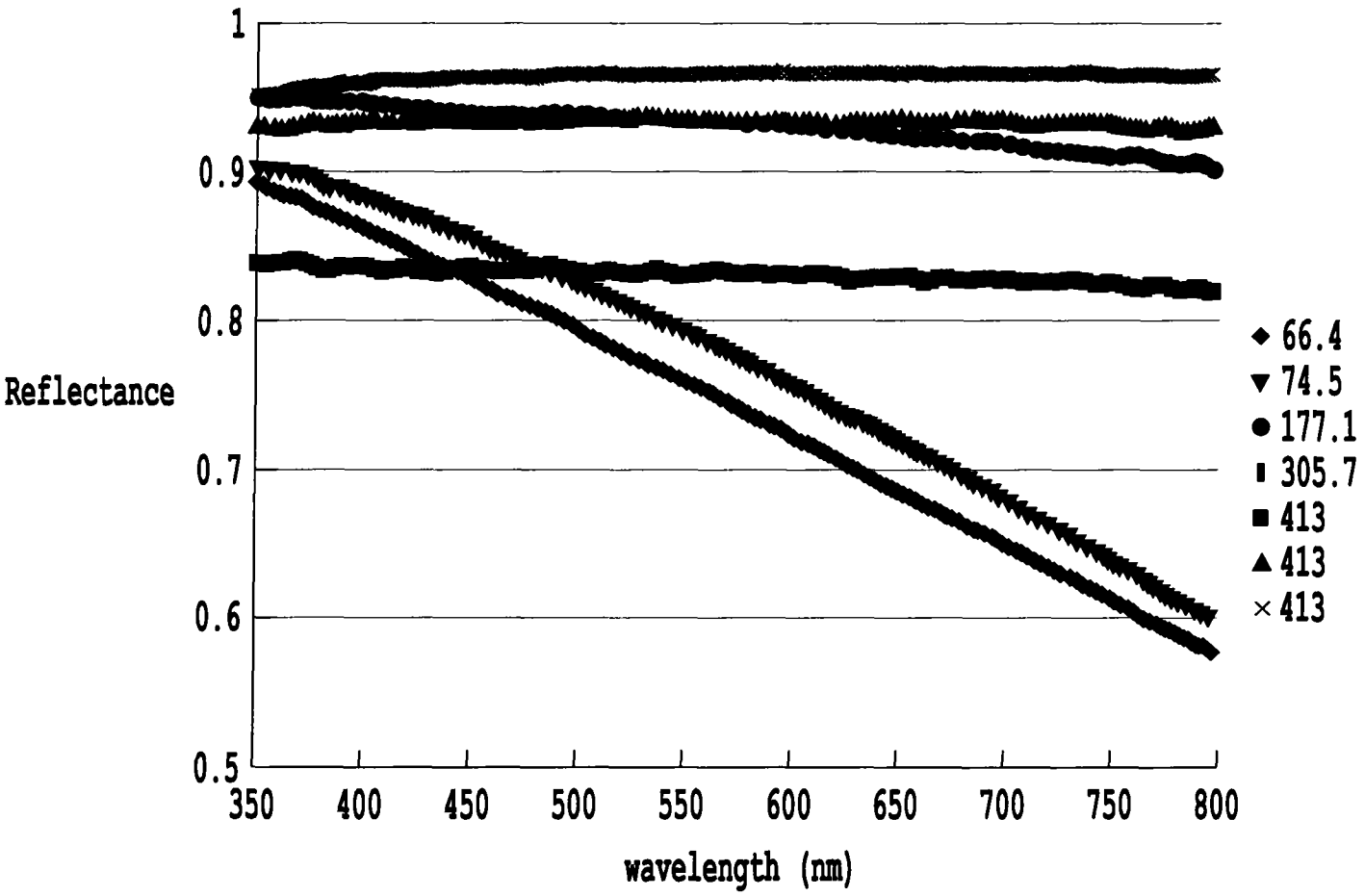
FIG. 12 is a graphical depiction of reflectance in the visible wavelengths at different average fiber diameters.

The reflectance of a series of nanofiber substrates at different fiber diameter are shown in FIG. 12. Specifically, FIG. 12 is a graph of reflectance in the visible wavelengths at different average fiber diameters (indicated on the right hand side). The three samples at AFD values of 413 nm demonstrate the effect of increasing the substrate basis weight.

The impact of increasing basis weight is shown with three samples with AFD values of 413 nm and basis weights of 17 (red block), 35 (green triangle), and 53 (X) gsm. Although the variability in reflectance value at 550 nm was found not to be significantly explained by the variability in fiber diameter, there is clearly a visual dependence of the slopes of these lines on fiber diameter.

The difference in reflectance at 550 nm and 750 nm was assigned the name DELTAREFLECT and used as an independent variable modeled against the influence of the various predictors. As shown in Table 3, MEANFIBERDIAM and BASISWT were found to be predictive and account for nearly 37% of the variation in DELTAREFLECT. Table 3 shows simulation results for the dependence of DELTAREFLECT on MEANFIBDIAM and BASISWT.

TABLE 3

| Variable Entered | Label | Number Vars In | Partial R-Square | F Value | Pr > F |
|---|---|---|---|---|---|
| MEANFIBDIAM | MEANFIBDIAM | 1 | 0.2922 | 10.73 | 0.0030 |
| BASISWT | BASISWT | 2 | 0.0771 | 3.06 | 0.0927 |

Nanofibers with AFD values ranging from 66 nm to 1,000 nm were examined. These nanofibers were fabricated using a variety of methods including electrospinning, melt spinning, and centrifugal spinning. Testing of the nanofiber substrate reflectance confirm the importance of these parameters on overall reflectance in the visible range.

The nanofiber substrates exhibiting high reflectance in this invention include an assembly of nanofibers exhibiting ensemble behavior which can be characterized by an average fiber diameter (AFD) and a standard distribution of the AFD value ($\sigma_{AFD}$). In this assembly, it is important to control both the AFD and $\sigma_{AFD}$ values of the nanofibers to achieve the specified mean flow pore diameter and bubble point values given herein. Generally, it is desirable for the AFD values to be in the range of 100 nm to 500 nm, and the $\sigma_{AFD}$ values to be in the same range. Preferably, the $\sigma_{AFD}$ values are less than 200 nm and most preferably less than 100 nm. If one or more of the AFD or $\sigma_{AFD}$ values falls outside this range, it is difficult to produce the tight fiber packing that is required to yield pore diameters in the specified range that results in the extremely high reflectance values described herein.

In addition, it is desirable for the interfiber pore diameter distribution to be controlled within a prescribed range. The mean flow pore diameter is the average diameter of all the interfiber pores in the material. The bubble point is the size of the largest interfiber pore in the material. The difference between bubble point and mean flow pore diameter provides a measure of the distribution in pore sizes in the substrate. If this value is large, then there is a large distribution of pore sizes in the material, and the material has a more open (i.e., less dense) structure. If this value is small, there is much less of a distribution of pore sizes and the spacing between adjacent fibers is better controlled. In the subject invention, it was also unexpectedly discovered that the highest reflectance values were achieved when the mean flow pore diameter was less than 80% of the bubble point. In the subject invention, the mean flow pore diameter is typically equal to or larger than the AFD value, while the bubble point may be small or comparable to the wavelength of light being reflected.

Starry (US Patent Appl. Publ. No. 2006/0262310) describes a non-woven substrate for use as a high diffuse reflectance material. The non-woven described in the '310 application consists of plexifilaments made using meltblow techniques and have fiber diameters larger than 500 nm (paragraph 48). Although the '310 application does not disclose $\sigma_{AFD}$ values, melt blown processes are known in the art to generally produce a broad distribution of fiber diameters and often result in $\sigma_{AFD}$ values greater than 1,000 nm. Given the AFD and $\sigma_{AFD}$ values anticipated in the '310 patent application, it is not possible to produce the mean flow pore diameters and AFD values, at low (<30 grams per square meter) basis weights, specified in this application. This may explain why the technology described in the '310 patent application required basis weights in excess of 76 grams/square meter to achieve reflectance values greater than 0.95 (see Table I of the '310 patent application). As shown in FIG. 12, this invention is able to achieve reflectance values in excess of 0.95 at a basis weight of only 20 grams/square meter.

Specific examples of the reflective fiber mat of this invention are described below.

Figures 1, 13A:
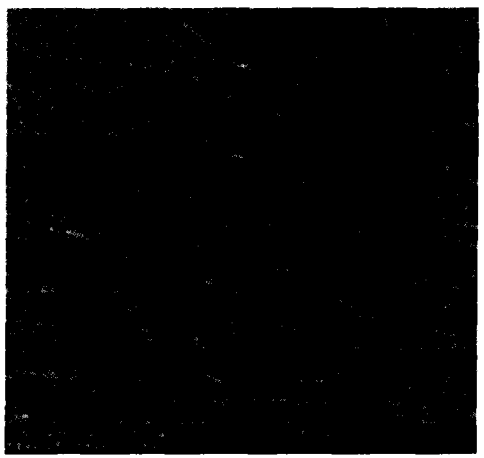
Figures 2, 13A:
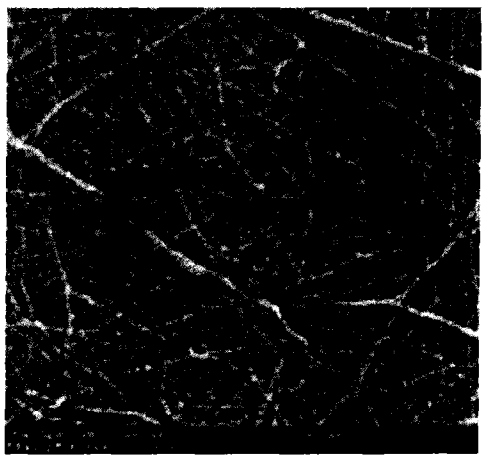
Figures 3, 13A:
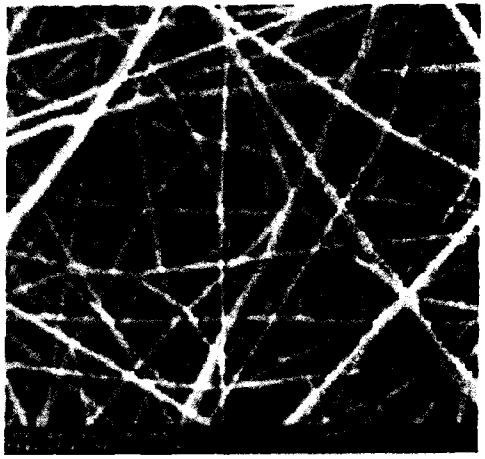

FIG. 13A depicts a series of SEM micrographs at progressively higher magnifications of a reflective finer of this invention having a basis weight of 28 grams per square meter (gsm). The fiber diameter distribution statistics for the 28 gsm nanofiber reflector substrate shown in FIG. 13A are given in the table below, where N is the number of measurements that were used to determine the statistic distribution:

TABLE 4

| | Value |
|---|---|
| N | 100 |
| Minimum Fiber Diameter | 90 |
| Maximum Fiber Diameter | 1089 |
| Average Fiber Diameter | 172 |
| Fiber Diameter Standard Deviation | 105 |
| Material | Nylon-6 |

Figure 13B:
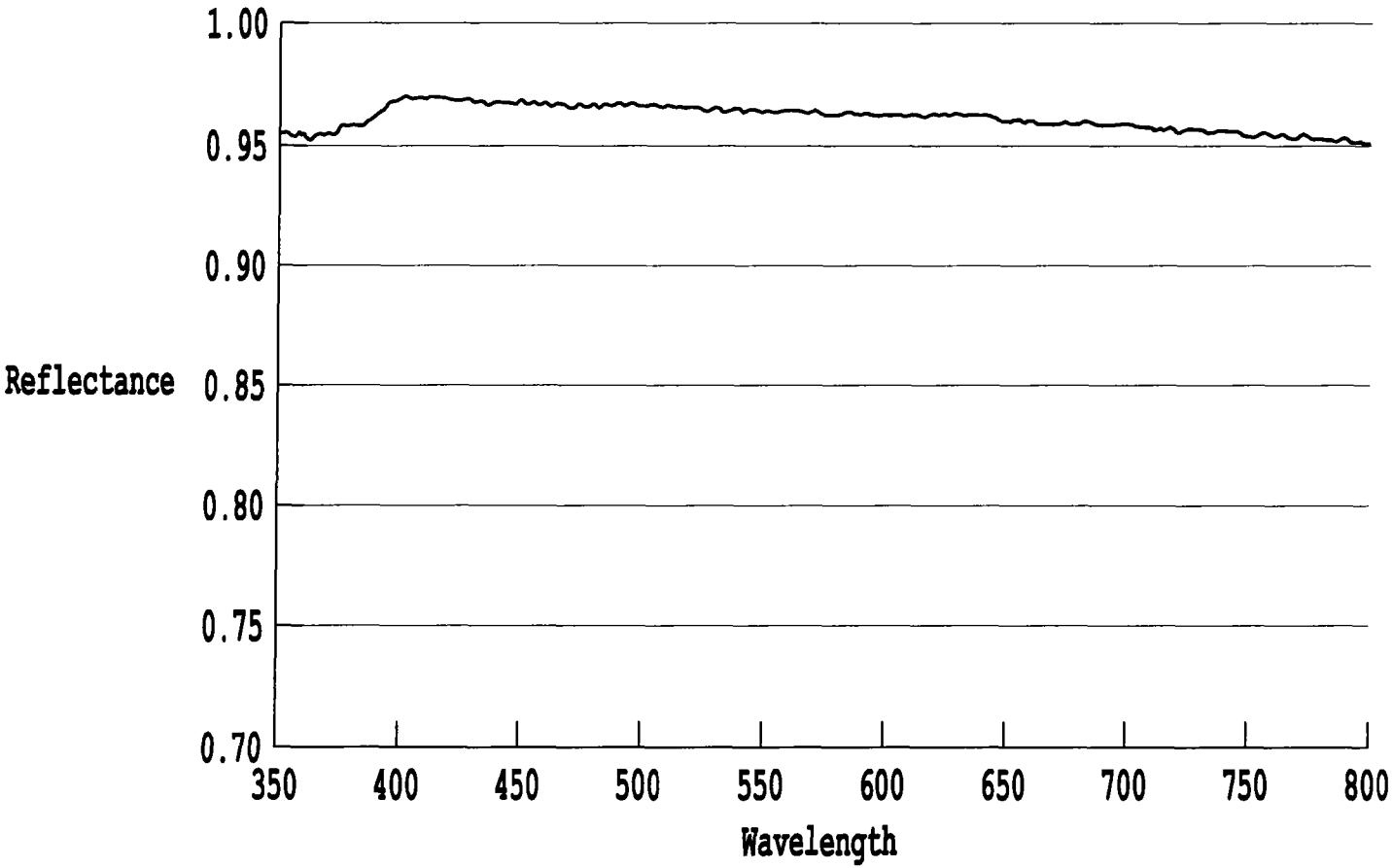
FIG. 13B is a graphical depiction of reflectance in the visible wavelengths for the fiber mat of FIG. 13A.

FIG. 13B is a graphical depiction of reflectance in the visible wavelengths for the fiber mat of FIG. 13A.

Figures 1, 14A:
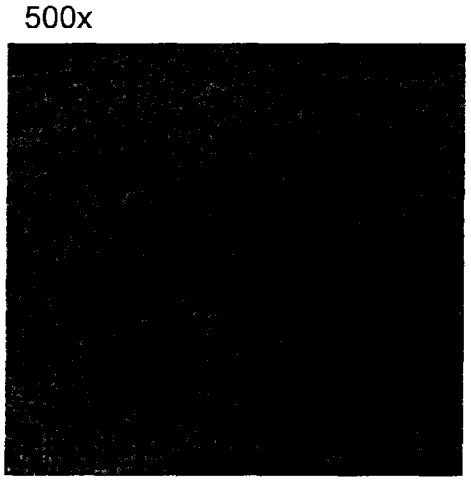
Figures 2, 14A:
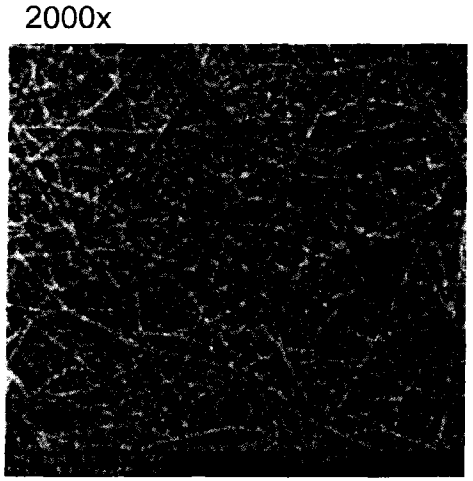
Figures 3, 14A:
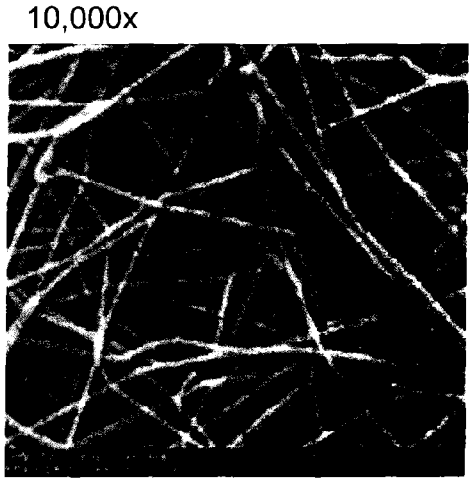

FIG. 14A depicts a series of SEM micrographs at progressively higher magnifications of a reflective fiber mat of this invention having a basis weight of 14 grams per square meter (gsm). The fiber diameter distribution statistics for the 14 gsm nanofiber reflector substrate shown in FIG. 14A are given in the table below, where N is the number of measurements that were used to determine the statistic distribution:

TABLE 5

| | Value |
|---|---|
| N | 100 |
| Minimum Fiber Diameter | 74 |
| Maximum Fiber Diameter | 794 |
| Average Fiber Diameter | 177 |
| Fiber Diameter Standard Deviation | 83 |
| Material | Nylon-6 |

Figure 14B:
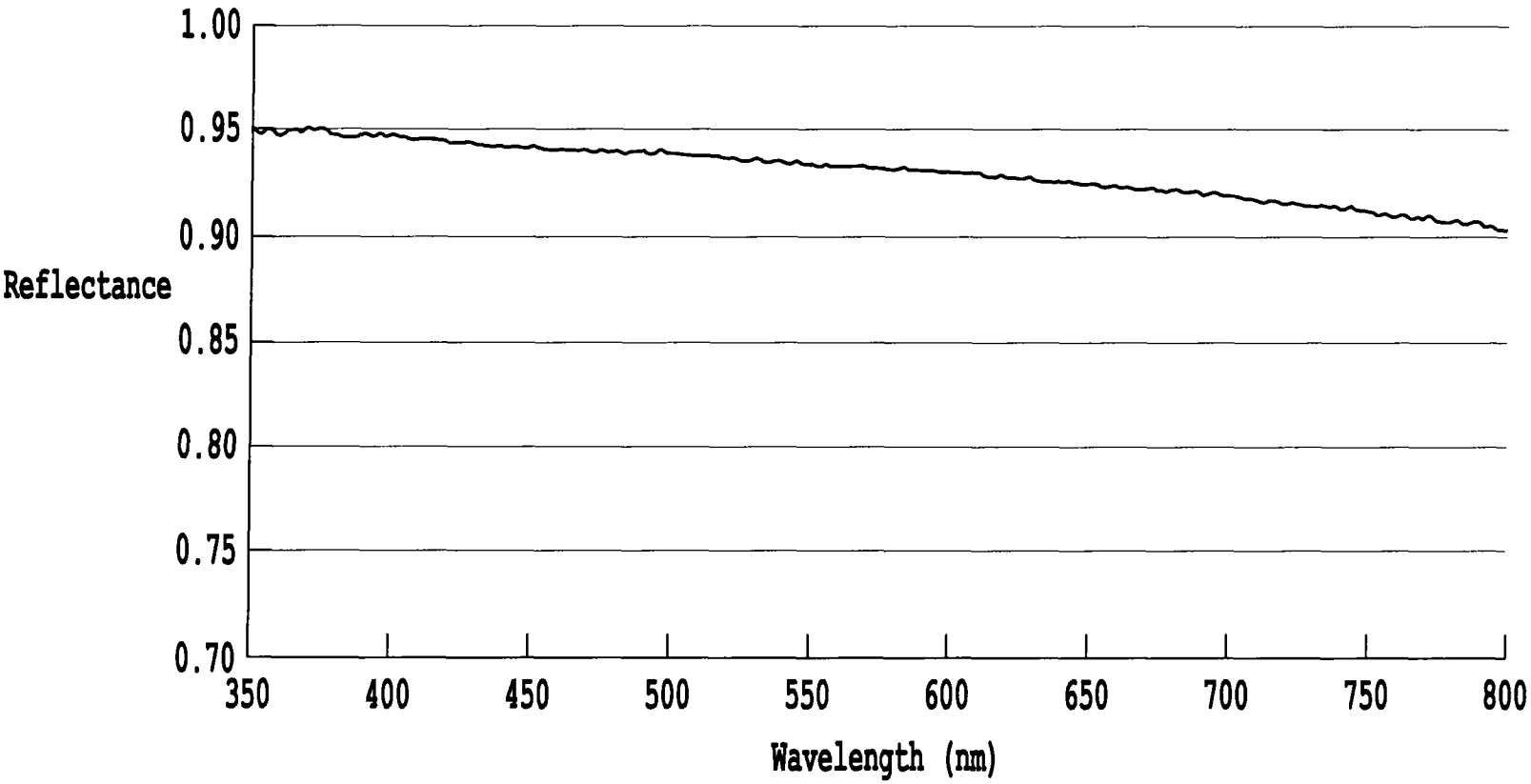
FIG. 14B is a graphical depiction of reflectance in the visible wavelengths for the fiber mat of FIG. 14A.

FIG. 14B is a graphical depiction of reflectance in the visible wavelengths for the fiber mat of FIG. 14A.

Accordingly, this invention with the improvements described here includes the following elements.

1. A nanofiber-based structure that diffusely reflects light in which the average fiber diameter (AFD) is smaller that the in vacuo wavelength of light that is being reflected. The in vacuo wavelength of visible light is roughly 400 nm to 750 nm.
2. The structure in item #1 above that also contains pores between adjacent fibers creating a mean flow pore diameter as defined by porosimetry using a lightweight organic fluid such as Galwick. The mean flow pore diameter can be either smaller or larger than the in vacuo wavelength of light being reflected.
3. The structure in item #2 above in which the pores also comprise a maximum pore size as measured by the bubble point in porometer using a light weight organic fluid such as Galwick. The bubble point is typically larger than the in vacuo wavelength of light being reflected. However, if high efficiency reflectors, the bubble point of the nanofiber substrate may be smaller than at least some of the visible light being reflected.
4. The structure in item #3 above in which the AFD varies between 50 nm and 500 nm.
5. The structure in item #4 above in which the mean flow pore diameter varies between 50 nm and 20,000 nm.
6. The structure in item #5 above in which the bubble pore varies between 50 nm and 200,000 nm.
7. The structure in item #6 above in which the mean flow pore diameter is greater than the AFD value and the bubble point is greater than both. Exemplary ranges of fiber properties for a nanofiber substrate according to one aspect of this invention is given below:
   AFD: 150 to 200 nm
   Mean Flow Pore Diameter: 250-300 nm
   Bubble Point Pore Diameter: 650-800 nm
   Basis Weight: 20-40 gsm
   Reflectance @550 nm: 0.85 to 0.95
   One specific example is:
   AFD: 172 nm
   Mean Flow Pore Diameter: 270 nm
   Bubble Point Pore Diameter: 720 nm
   Basis Weight: 28 gsm
   Reflectance @550 nm: 0.963
   Another specific example is:
   AFD: 177 nm Mean Flow Pore Diameter: 420 nm
Bubble Point Pore Diameter: 610 nm
Basis Weight: 14 gsm
Reflectance @550 nm: 0.935
Another specific example is:
AFD: 284 nm
Mean Flow Pore Diameter: 1410 nm
Bubble Point Pore Diameter: 2120 nm
Basis Weight: 9.8 gsm
Reflectance @550 nm: 0.870
Another specific example is:
AFD: 75 nm
Mean Flow Pore Diameter: 230 nm
Bubble Point Pore Diameter: 270 nm
Basis Weight: 5 gsm
Reflectance @550 nm: 0.80
Another specific example is:
AFD: 115 nm
Basis Weight: 5 gsm
Reflectance @550 nm: 0.929
Another specific example is:
AFD: 306 nm
Basis Weight: 20 gsm
Reflectance @550 nm: 0.933

8. The structure in item #6 above in which the mean flow pore diameter is approximately equal to the AFD value and the bubble point is greater than both. Exemplary ranges of fiber properties for a nanofiber substrate according to one aspect of this invention is given below:
AFD: 150-200 nm
Mean Flow Pore Diameter: 150-200 nm
Bubble Point Pore Diameter: 200-300 nm
One specific example is:
AFD: 175 nm
Mean Flow Pore Diameter: 175 nm
Bubble Point Pore Diameter: 250 nm.

9. The structure as defined in items 1-8 above in which the basis weight is less than 40 gsm.

10. A method for optimizing the reflectance of a nanofiber substrate by simultaneously adjusting the mean flow pore diameter and the basis weight. As discussed above, reflectance can be increased by reducing mean flow pore diameter (due to the negative coefficient) and by increasing basis weight (due to the positive coefficient). So one method to increase reflectance is to simultaneously reduce mean flow pore diameter and increase basis weight. In a fiber spinning tool, such as an electrospinning, centrifugal spinning, or melt spinning tool, reducing mean flow pore diameter and increasing basis weight can be achieved by reducing throughput belt speed.

11. A method of optimizing the reflectance of a nanofiber substrate by adjusting either the mean flow pore diameter or the basis weight but not both. As discussed above, reflectance can be increased by reducing mean flow pore diameter (due to the negative coefficient) and by increasing basis weight (due to the positive coefficient). So one method to increase reflectance is to reduce either mean flow pore diameter or increase basis weight. One method to decrease mean flow pore diameter is to increase the density of the nanofiber substrate and one way to increase the basis weight is to increase the thickness of the nanofiber substrate. A method of optimizing the flatness or slope of the reflectance profile of a nanofiber substrate adjusts the average fiber diameter. As shown in FIG. 18, small average fiber diameters (typically below 125 nm) result in a reflectance profile that has a higher value at 400 nm than at 700 nm. Hence, achieving an AFD value between 150 nm and 500 nm will result in a relatively flat reflectance profile over the visible light range. Since AFD values can be controlled by adjusting the concentration of the spinning solution and the spinning rate, there is an optimal range of these variable that can produce the fibers having AFD values between 150 and 500 nm that result in a flat reflectance profile.

12. A method optimizing a nanofiber reflector substrate to achieve a desired reflectance and slope of the reflectance profile by adjusting mean flow pore diameter, basis weight, and average fiber diameter. These adjustments may be performed simultaneously or sequentially.

13. Methods of optimizing a nanofiber reflector using approaches similar to those described in items 9, 10, 11, 12, 13 except that bubble point is used as a predictor instead of mean flow pore diameter. As described above, the difference between bubble point and mean flow pore diameter provides a measure of the distribution in pore sizes in the substrate. If this difference is large, then there is a large distribution of pore sizes in the material, and the material has a more open (i.e., less dense) structure. If this value is small, there is much less of a distribution of pore sizes and the spacing between adjacent fibers is smaller. In one embodiment of this invention, it was also unexpectedly discovered that the highest reflectance values were achieved when the mean flow pore diameter was less than 80% of the bubble point and most preferably the mean flow pore diameter is less than 50% of the bubble point. Since bubble point was found to be highly correlated with mean flow pore diameter, a high reflectance nanofiber structure can be produced by also optimizing only the bubble point.

14. A lighting device including a luminaire, LCD backlight, medical light or similar structures using a reflector material fabricated using the methods described above.

15. Fabricating the reflector material described above using any of the following processes: electrospinning, melt spinning, centrifugal spinning, shear spinning, force spinning or combinations and derivatives thereof.

The nanofiber reflector fabricated as described above can contain at least one of the following polymers: nylon, polypropylene, polyethylene, polyethylene terephthalate, polybutylene terephthalate, silicone, and poly(vindylidene fluoride).

Figure 15:
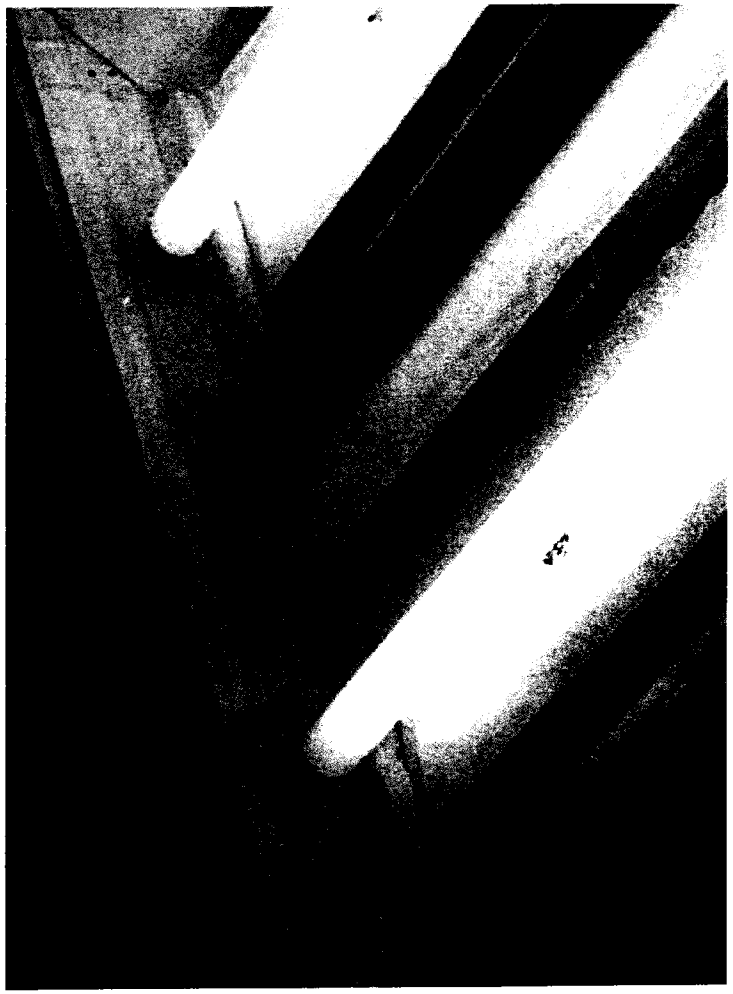
FIG. 15 is a photographic image of a high efficiency 2 foot by 4 foot fluorescent troffer equipped with nanofiber reflective mats behind the lamps.

Nanofiber mats were fabricated using the methods described herein and formed into reflector surfaces for use in luminaires. Table 6 presents comparisons of the performance of commercially available luminaires equipped with standard reflectors (e.g., painted metal and polished aluminum) and equivalent reflectors modified with the reflective nanofiber mats as described herein. The commercial luminaires tested included a 2 foot×4 foot fluorescent troffer with a diffusing lens, a high efficiency 2 foot×4 foot fluorescent troffer, and a 8" fluorescent downlight. A picture of the high efficiency fluorescent troffer equipped with a nanofiber-based reflector behind the fluorescent lamp is shown in FIG. 15.

TABLE 6

| Luminaire | Configuration | Efficiency | Lumens | Energy Saved Per Fixture Per Year |
|---|---|---|---|---|
| Lensed Troffer | Std. White Reflector, 4 Lamps @ 32 W ea. | 63%* | 6829 | — |
| | Nanofiber Reflector, 4 Lamps @ 32 W ea. | 81%* | 8780 | — |
| | Nanofiber Reflector, 3 Lamps @ 32 W ea. | 83%* | 6748 | 96 kWhr/fixture*** |
| Fluorescent Downlight | Std. Al Metal Reflector, 2 Lamps @ 26 W ea. | 58.1%** | 1987 | — |
| | Nanofiber Reflector, 2 Lamps @ 26 W ea. | 76.5%** | 2754 | — |
| | Nanofiber Reflector, 2 Lamps @ 18 W ea. | 76.5%** | 1836 | 24 kWhr/fixture*** |
| High Efficiency Troffer | Std. White Reflector, 2 Lamps @ 32 W ea. | 80.6%** | 4517 | — |
| | Nanofiber Reflector, 2 Lamps @ 32 W ea. | 86%* | 4819 | — |
| | Nanofiber Reflector, 2 Lamps @ 30 W ea. | 86%* | 4517 | 6 kWnr/fixture*** |

*Estimated from light meter readings in field tests
**Radiometric test results.
***Energy savings calculated assuming 3000 hours of annual operation.

The higher reflectance of the reflective nanofiber materials resulted in increased luminous flux (as measured in lumens) emanating from the luminaires in all cases compares to the equivalent comment product with traditional reflector technology. In addition, the luminaire efficiency, as measured by the ratio of the luminous flux emanating from the luminaire to that of the lamps alone, increased significantly when the nanofiber reflectors were used in place of standard reflector technologies. As a result, significant energy savings at equivalent lighting levels can be realized using the nanofiber reflectors described herein.

Numerous modifications and variations of the invention are possible in light of the above teachings. It is therefore to be understood that within the scope of the appended claims, the invention may be practiced otherwise than as specifically described herein.

The invention claimed is:

1. A fiber-based reflective lighting device comprising:
a source configured to generate a primary light;
a substrate including a mat of reflective nanofibers, the fibers having an average fiber diameter AFD less than 500 nm which diffusively reflects visible light upon illumination with at least the primary light;
said mat having a basis weight less than 40 gram per square meter (gsm) and a reflectance greater than 80%; and
a light exit configured to emanate the reflected light.

2. The device of claim 1, where said basis weight of the mat is less than 30 gsm.

3. The device of claim 1, where said basis weight of the mat is less than 20 gsm.

4. The device of claim 1, where said reflectance of the mat greater than 90%.

5. The device of claim 1, where said reflectance of the mat greater than 95%.

6. The device of claim 1, further comprising:
a luminescent sheet having light stimulatable particles configured to emit secondary light upon receiving the primary light.

7. The device of claim 6, wherein the mat comprises:
at least one of a planar or a curved reflector surface disposed behind or in front of the luminescent sheet.

8. The device of claim 7, wherein the reflector surface comprises spherical or cylindrical reflector surfaces.

9. The device of claim 6, wherein the source comprises at least two light sources disposed to illuminate the luminescent sheet.

10. The device of claim 1, where said mat has an average interfiber spacing, as measured by mean flow pore diameter, that is less than 80% of the maximum interfiber spacing, as measured by bubble point.

11. The device of claim 1, where said mat has an average interfiber spacing, as measured by mean flow pore diameter, that is less than 90% of the maximum interfiber spacing, as measured by bubble point.

12. The device of claim 1, wherein
AFD ranges from 150 to 300 nm;
Mean Flow Pore Diameter ranges from 250-600 nm;
Bubble Point Pore Diameter ranges from 450-1,000 nm;
Basis Weight ranges from 5-40 gsm; and
Reflectance @550 nm ranges from 0.85 to 0.999.

13. The device of claim 1, wherein
AFD ranges from 150-250 nm;
Mean Flow Pore Diameter ranges from 150-300 nm; and
Bubble Point Pore Diameter ranges from 200-400 nm.

14. The device of claim 1, wherein the reflective fibers include at least one of Al, Au, Ag, $TiO_2$, ZnO, $BaSO_4$, and Zn.

15. The device of claim 1, wherein the mat comprises a reflective material having a reflectance greater than 0.9.

16. The device of claim 1, wherein the fibers comprise polymer fibers.

17. The device of claim 16, wherein the polymer nanofibers comprise at least one of poly(dimethyl siloxane), poly(vinylidene fluoride), poly(ethylene oxide), poly(methyl methacrylate), poly(propylene), poly(vinyl alcohol), poly(ethylene), nylon 6, nylon 6-12, nylon 6-6, polycarbonate, polyamide, polysulfone, polybutylene terephthlate, and polyethylene terephthlate, or combinations thereof.

18. The device of claim 1, wherein the source configured to generate said primary light comprises a light emitting diode.

19. The device of claim 18, where the light emitting diode emits visible light.

20. The device of claim 1, wherein the source configured to generate said primary light comprises a fluorescent lamp.

21. The device of claim 1, further comprising:
stimulatable particles disposed at least on a surface of the reflective nanofiber mat or a surface of nanofibers separate from the reflective nanofiber mat.

22. The device of claim 21, wherein the stimulatable particles comprise at least one of quantum dots and phosphors.

23. The device of claim 22, wherein the quantum dots comprise at least one of silicon, germanium, indium phosphide, indium gallium phosphide, indium phosphide, cadmium sulfide, cadmium selenide, lead sulfide, copper oxide, copper selenide, gallium phosphide, mercury sulfide, mercury selenide, zirconium oxide, zinc oxide, zinc sulfide, zinc selenide, zinc silicate, titanium sulfide, titanium oxide, and tin oxide.

24. The device of claim 22, wherein the phosphors comprise at least one of a rare-earth doped metal oxide including $Y_2O_3$:Tb, $Y_2O_3$:$Eu^{3+}$, $Lu_2O_3$:$Eu^{3+}$, $CaTiO_3$:$Pr^{3+}$, CaO:$Er^{3+}$, (GdZn)O:$Eu^{3+}$, $Sr_4Al_{14}O_{25}$:$Eu^{3+}$, $GdMgB_3O_{10}$:$Ce^{3+}$:$Tb^{3+}$, $CeMgAl_11O_{19}$:$Ce^{3+}$:$Tb^{3+}$, $Y_2O_3$:$Eu^{3+}$, a rare-earth doped yttrium aluminum garnet (YAG) including YAG:$Ce^{3+}$, a rare-earth doped zirconium oxide including $ZrO_2$:$Sm^{3+}$ and $ZrO_2$:$Er^{3+}$, rare earth doped vanadates and phosphates including ($YVO_4$:Eu) and (La,Ce,Tb)$PO_4$, doped materials having a host matrix including one $Gd_2O_3$, $GdO_2S$, PbO, ZnO, ZnS, and ZnSe and including one of a dopant of Eu, Tb, Tm and Mn, metal-doped forms of zinc sulfide and zinc selenide including ZnS:$Mn^{2+}$ and ZnS:$Cu^{+}$, $Zn_{0.25}Cd_{0.75}S$:AgCl, metal sulfides including CaS:$Eu^{2+}$, $SrGa_2S_4$:Eu and $Ca_wSr_xGa_y(S,Se)_z$:Eu, doped silicates, and metal silicates including $Ca_3(Sc,Mg)_2Si_3O_{12}$:Ce and $(Ba,Sr)_2SiO_4$:Eu.

25. The device of claim 22, wherein the phosphors comprise at least one of rare-Earth doped YAG, rare-Earth doped ZnS, rare-Earth doped $SrGa_2S_4$, rare-Earth doped ZnSe, rare-Earth doped silicates, and sulfoselenides.

26. The device of claim 22, wherein the phosphor comprises a nano-phosphor.

27. The device of claim 1, wherein the mat reflects at least 90% of all visible light from 400 nm to 720 nm.

28. The device of claim 1, wherein the mat reflects at least 95% of all visible light from 400 nm to 720 nm.

29. The device of claim 1, wherein the mat reflects at least 97% of all visible light from 420 nm to 720 nm.

30. A lighting device insert comprising:

a substrate including a nanofiber mat of reflective fibers, the fibers having an average fiber diameter less than 500 nm which diffusively reflects visible light upon illumination with at least a primary light;

said nanofiber mat having an average interfiber spacing, as determined by mean flow pore diameter, that is less than 80% of the maximum interfiber spacing, as determined by the bubble point;

said nanofiber mat configured to diffusively reflect at least 80% of incident light.

31. A method for diffusively reflecting visible light, comprising:

directing a primary light beam to a mat of reflective nanofibers;

diffusively reflecting visible light from the mat of reflective nanofibers, said nanofibers having an average fiber diameter less than 500 nm and the mat has an average interfiber spacing, as determined by mean flow pore diameter, that is less than 80% of the maximum interfiber spacing, as determined by the bubble point.

* * * * *